US011249434B2

(12) United States Patent
Tamura et al.

(10) Patent No.: US 11,249,434 B2
(45) Date of Patent: Feb. 15, 2022

(54) IMAGE FORMING APPARATUS INCLUDING OPTICAL PRINT HEAD

(71) Applicant: CANON KABUSHIKI KAISHA, Tokyo (JP)

(72) Inventors: Yuya Tamura, Tsukuba (JP); Hitoshi Iwai, Abiko (JP); Takehiro Ishidate, Tokyo (JP); Shinichiro Hosoi, Tokyo (JP); Toshiki Momoka, Tokyo (JP); Daisuke Aruga, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/398,952

(22) Filed: Apr. 30, 2019

(65) Prior Publication Data

US 2019/0346804 A1 Nov. 14, 2019

(30) Foreign Application Priority Data

May 11, 2018 (JP) ..... JP2018-091893

(51) Int. Cl.
*G03G 15/00* (2006.01)
*G03G 21/16* (2006.01)

(52) U.S. Cl.
CPC ..... *G03G 15/80* (2013.01); *G03G 21/1647* (2013.01); *G03G 21/1652* (2013.01)

(58) Field of Classification Search
CPC ..... G03G 21/1666; G03G 15/04054; G03G 15/04036
See application file for complete search history.

(56) References Cited

U.S. PATENT DOCUMENTS 7,954,917 B2 * 6/2011 Inoue ..... G06K 15/1242 347/9
9,304,477 B2 4/2016 Sone
2009/0169228 A1 * 7/2009 Yokoi ..... G03G 15/80 399/51
2012/0183322 A1 * 7/2012 Sato ..... G03G 21/1661 399/110
2014/0002571 A1 1/2014 Aruga
2014/0356017 A1 * 12/2014 Kobayashi ..... G03G 21/1666 399/98
2015/0309468 A1 * 10/2015 Sone ..... G03G 15/80 347/118
2016/0207328 A1 * 7/2016 Otoguro ..... G03G 15/04072
2017/0060081 A1 * 3/2017 Kikuchi ..... G03G 21/1671
2019/0129327 A1 5/2019 Aruga et al.
2019/0129353 A1 5/2019 Hosoi et al.
2019/0129354 A1 5/2019 Momoka et al.

FOREIGN PATENT DOCUMENTS

JP 2015-205497 A 11/2015

* cited by examiner

*Primary Examiner* — Walter L Lindsay, Jr.
*Assistant Examiner* — Jessica L Eley
(74) *Attorney, Agent, or Firm* — Venable LLP

(57) ABSTRACT

In an image forming apparatus including an optical print head, a length of a cable from a regulating portion to a connecting portion in a state where the connecting portion is connected to a connector is set to a length that enables the connector to be located on a front side of an opening when the optical print head moves to a pull-out position in the state where the connecting portion is connected to the connector.

14 Claims, 14 Drawing Sheets

IMAGE FORMING APPARATUS INCLUDING OPTICAL PRINT HEAD

BACKGROUND OF THE INVENTION

Field of the Invention

The present invention relates to an image forming apparatus including an optical print head.

Description of the Related Art

Some image forming apparatuses such as printers and copying machines have optical print heads that include a plurality of light emitting elements configured to expose a photosensitive drum to light. Some of the optical print heads use a light emitting diode (LED), organic electro luminescence (EL), or the like as an example of the light emitting element. An optical print head in which a plurality of such light emitting elements is arrayed, for example, in one row or two zigzag rows along a rotational axis direction of the photosensitive drum has been known. In addition, the optical print head includes a plurality of lenses configured to collect light emitted from the plurality of light emitting elements on the photosensitive drum. The plurality of lenses is arranged to oppose a surface of the photosensitive drum along an array direction of the light emitting elements between the plurality of light emitting elements and the photosensitive drum.

The optical print head has a smaller volume than a laser scanner unit (LSU) using a polygon mirror and has no driving portion, and thus, is advantageous for size reduction and noise reduction of the apparatus.

Meanwhile, the plurality of light emitting elements provided in the optical print head emits light in response to a drive signal from a controller provided in the image forming apparatus. The drive signal from the controller is transmitted to the optical print head via a cable. Japanese Patent Laid-Open No. 2015-205497 describes a technique of using a flexible flat cable (FFC) in order to supply electric power from a controller of an image forming apparatus to an exposure device (an LED substrate).

In addition, Japanese Patent Laid-Open No. 2015-205497 describes a method of attaching an optical print head to the image forming apparatus and a method of detaching the optical print head from the image forming apparatus. According to the description of Japanese Patent Laid-Open No. 2015-205497, a projection is formed on an end portion of the optical print head. When an operator inserts the optical print head from a front side of an image forming apparatus body into the inside of the apparatus body, the projection is fitted into a hole formed on a rear side of the image forming apparatus.

According to Japanese Patent Laid-Open No. 2015-205497, a part of the cable is fastened to a support plate (a regulating portion). As a result, a part of the cable is regulated from moving in a direction in which the optical print head is pulled out. In addition, a curved area of the cable is provided between the regulating portion and a part connected to a connector. When replacing the optical print head, the operator pulls the optical print head located at a mounting position toward the front side (up to a pull-out position) by the amount corresponding to the curved amount of the curved area of the cable through an opening formed in a front plate. Then, the operator detaches the cable from the connector provided on the optical print head on the back side of the front plate. Thereafter, the operator pulls out the optical print head toward the front side to be replaced with a new optical print head, thereby performing maintenance.

In Japanese Patent Laid-Open No. 2015-205497, however, it is difficult to make the connector located on the front side of the opening when the optical print head is moved from the mounting position to the pull-out position in a state where the cable is connected to the connector. Thus, it is difficult for the operator to touch the connector and the cable on the front side of the opening, and the work of detaching the cable from the connector is troublesome.

SUMMARY OF THE INVENTION

An image forming apparatus according to an embodiment of the present invention includes a photosensitive drum rotatable with respect to an apparatus body; an optical print head that has a connector and exposes the photosensitive drum to light in response to a drive signal from a controller, the optical print head movable from a mounting position where the optical print head is mounted to the apparatus body to a pull-out position where the optical print head is pulled out in a rotational axis direction of the photosensitive drum toward a front side of the apparatus body; a front plate located at the front side of the apparatus body and is formed with an opening through which the optical print head is pulled out from the mounting position toward the pull-out position by an operator; a cable that has a connecting portion connected to be detachably attachable to the connector and transmits the drive signal from the controller to the optical print head; and a regulating portion that is provided on the apparatus body to regulate movement of a part of the cable in the direction in which the cable is pulled out from apparatus body. A length of the cable from the regulating portion to the connecting portion in a state where the connecting portion is connected to the connector is a length that enables the connector to be located on the front side of the opening when the optical print head moves to the pull-out position in the state where the connecting portion is connected to the connector.

Further features of the present invention will become apparent from the following description of exemplary embodiments with reference to the attached drawings.

DESCRIPTION OF THE EMBODIMENTS (Image Forming Apparatus)

Figure 1:
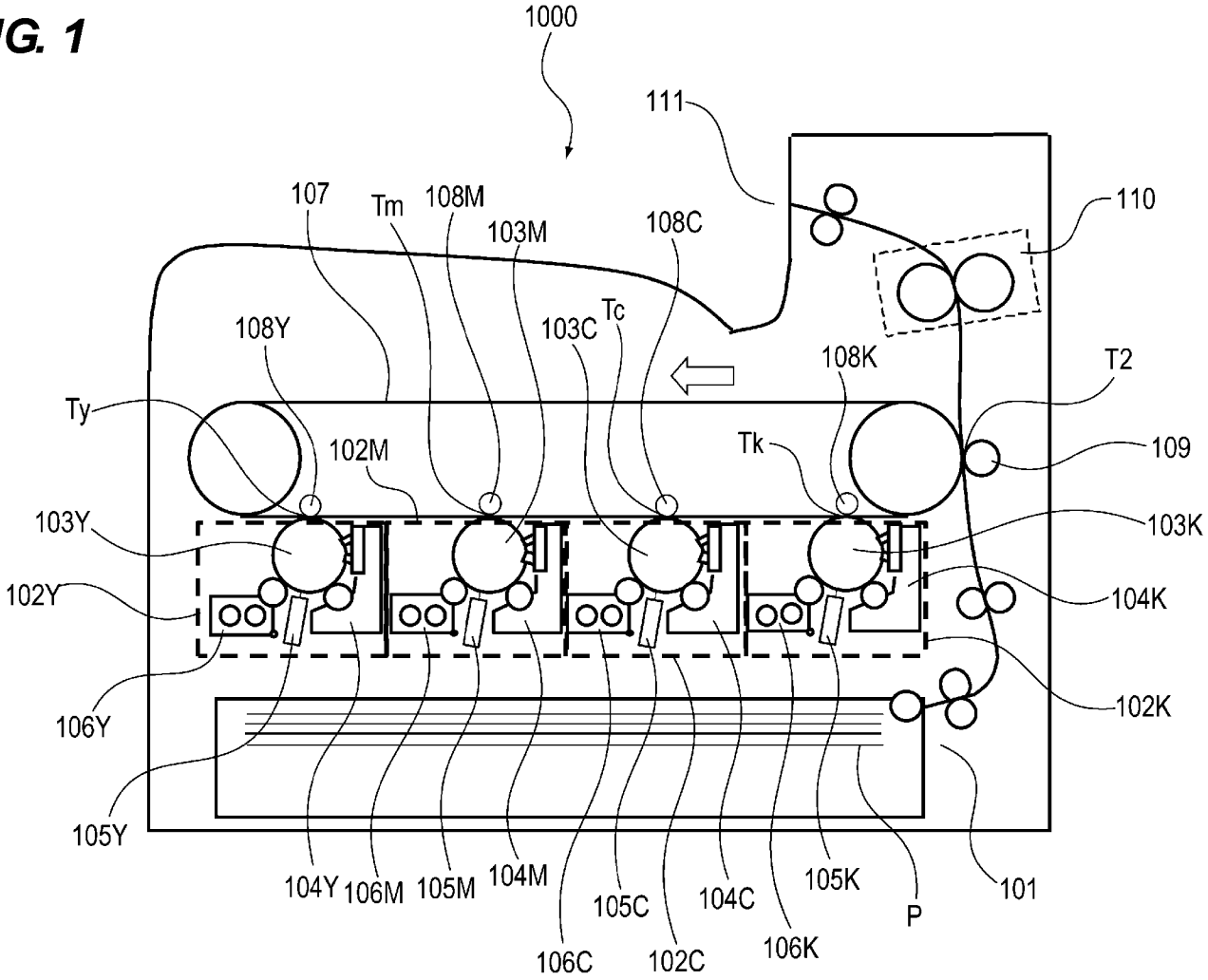
FIG. 1 is a cross-sectional view illustrating a configuration of an image forming apparatus.

First, a schematic configuration of an image forming apparatus 1000 will be described with reference to FIG. 1. FIG. 1 is a schematic cross-sectional view of the image forming apparatus 1000. The image forming apparatus 1000 illustrated in FIG. 1 is a color printer (SFP: single function printer) not including a reading device, but an embodiment may be a copying machine including a reading device.

The image forming apparatus 1000 illustrated in FIG. 1 includes four image forming portions 102Y, 102M, 102C, and 102K (hereinafter collectively referred to simply as an "image forming portion 102") that form toner images of the respective colors of yellow, magenta, cyan, and black. The image forming portions 102Y, 102M, 102C, and 102K include photosensitive drums 103Y, 103M, 103C, and 103K (hereinafter collectively referred to simply as a "photosensitive drum 103"), respectively. Chargers 104Y, 104M, 104C, and 104K (hereinafter collectively referred to simply as a "charger 104") that charge the photosensitive drum, optical print heads 105Y, 105M, 105C, and 105K (hereinafter collectively referred to simply as an "optical print head 105") that expose the photosensitive drum to light, and development devices 106Y, 106M, 106C, and 106K (hereinafter collectively referred to simply as a "development device 106") that develops an electrostatic latent image on the photosensitive drum with toner are provided around the respective photosensitive drums. Incidentally, Y, M, C, and K attached to reference signs indicate toner colors (Y: yellow, M: magenta, C: cyan, and K: black).

The image forming apparatus 1000 illustrated in FIG. 1 is an image forming apparatus that adopts a so-called "lower surface exposure system" that exposes the photosensitive drum 103 to light from below. Hereinafter, a description will be given on the premise of the image forming apparatus adopting the lower surface exposure system, but an image forming apparatus adopting an "upper surface exposure system" that exposes the photosensitive drum 103 to light from above may be used as an embodiment.

The image forming apparatus 1000 includes: an intermediate transfer belt 107 to which a toner image formed on the photosensitive drum 103 is transferred; and primary transfer rollers 108 (Y, M, C, and K) which sequentially transfer the toner images formed on the photosensitive drum 103 to the intermediate transfer belt. The image forming apparatus 1000 further includes: a secondary transfer roller 109 which transfers the toner image on the intermediate transfer belt 107 onto a recording sheet P conveyed from a sheet feeding portion 101; and a fixer 110 that fixes the secondarily transferred image on the recording sheet P. The photosensitive drums 103Y, 103M, 103C, and 103K are in contact with the intermediate transfer belt 107 and form primary transfer portions Ty, Tm, Tc, and Tk together with the primary transfer rollers 108Y, 108M, 108C, and 108K.

(Image Forming Process)

Next, an image forming process of the image forming apparatus will be briefly described. The charger 104Y charges the surface of the photosensitive drum 103Y. The optical print head 105Y exposes the surface of the photosensitive drum 103Y charged by the charger 104Y to light. As a result, an electrostatic latent image is formed on the photosensitive drum 103Y. Next, the development device 106Y develops the electrostatic latent image formed on the photosensitive drum 103Y with a yellow toner. The yellow toner image developed on the surface of the photosensitive drum 103Y is transferred onto the intermediate transfer belt 107 by the primary transfer roller 108Y in the primary transfer portion Ty. Magenta, cyan, and black toner images are also formed in the similar image forming process and are transferred in each of the primary transfer portions so as to be superimposed on each other on the intermediate transfer belt 107.

The toner images of the respective colors transferred onto the intermediate transfer belt 107 are conveyed to a secondary transfer portion T2 by the intermediate transfer belt 107. A transfer bias to transfer the toner image onto the recording sheet P is applied to the secondary transfer roller 109 arranged in the secondary transfer portion T2. The toner image conveyed to the secondary transfer portion T2 is transferred to the recording sheet P conveyed from the sheet feeding portion 101 by the transfer bias of the secondary transfer roller 109. The recording sheet P onto which the toner image has been transferred is conveyed to the fixer 110. The fixer 110 fixes the toner image on the recording sheet P by heat and pressure. The recording sheet P subjected to the fixing process by the fixer 110 is discharged to a sheet discharging portion 111.

(Drum Unit and Developing Unit)

Figure 2A:
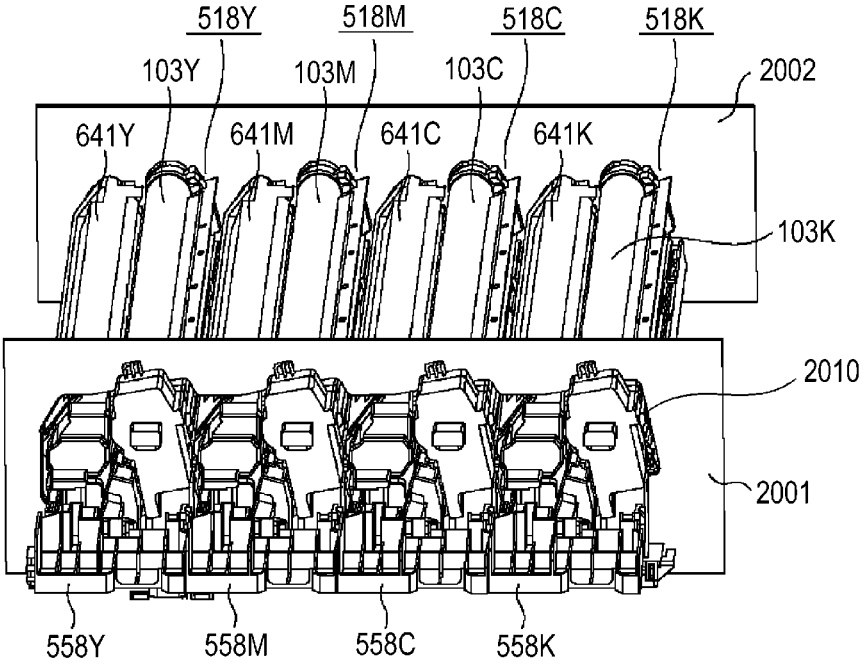
FIGS. 2A and 2B are views illustrating a periphery of a drum unit and a periphery of a developing unit of the image forming apparatus.
Figure 2B:
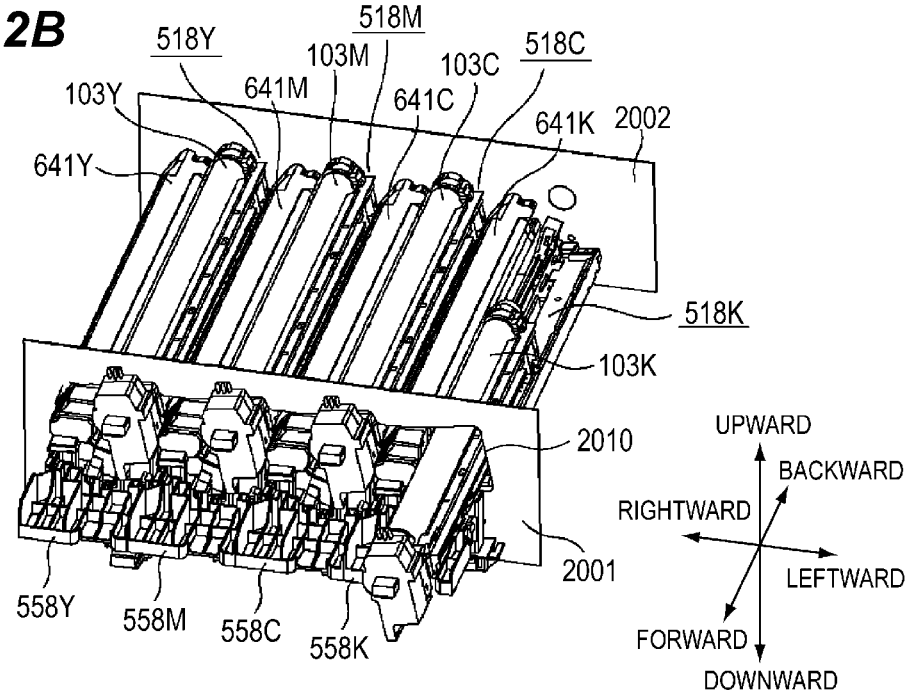

A replaceable drum unit in the image forming apparatus of the embodiment will be described by way of example. The photosensitive drum 103 and the charger 104 described above may be integrally unitized (as a drum unit or a drum cartridge) together with a cleaning device (not illustrated). An example of such a configuration will be described with reference to FIGS. 2A and 2B. FIG. 2A is a perspective view illustrating a schematic structure of a periphery of a drum unit 518 and a periphery of a developing unit 641 of the image forming apparatus 1000. FIG. 2B is a view illustrating a state where the drum unit 518 is inserted into the image forming apparatus 1000 from the outer side of the apparatus body.

As illustrated in FIGS. 2A and 2B, replaceable drum units 518Y, 518M, 518C, and 518K (hereinafter collectively referred to simply as the "drum unit 518") are attached to the image forming apparatus 1000 of the embodiment. The drum unit 518 is a cartridge replaceable by an operator such as a user and a maintenance person. The drum unit 518 of the embodiment rotatably supports the photosensitive drum 103. More specifically, the photosensitive drum 103 is rotatably supported with respect to a frame body (housing) of the drum unit 518. For example, when service life of the photosensitive drum 103 has expired due to wear by cleaning of the cleaning device, the operator who performs maintenance takes out the drum unit 518 from the apparatus body of the image forming apparatus 1000 through an opening 2010 formed in a front plate 2001 to be described later to replace the photosensitive drum 103. Incidentally, the drum unit 518 may be configured to include the photosensitive drum 103 without including the charger 104 and the cleaning device.

As illustrated in FIGS. 2A and 2B, developing units 641Y, 641M, 641C, and 641K (hereinafter collectively referred to simply as the "developing unit 641"), which are separate bodies from the drum unit 518, are attached to the image forming apparatus 1000 of the embodiment. The developing unit 641 of the embodiment is a cartridge in which the development device 106 illustrated in FIG. 1 and a toner accommodating portion are integrated. The development device 106 includes a developing sleeve which is a developer carrying member which carries a developer. The developing unit 641 is provided with a plurality of gears configured to rotate a screw that stirs the toner and the carrier. When these gears deteriorate over time, the operator removes the developing unit 641 from the apparatus body of the image forming apparatus 1000 to replace the developing unit 641. Incidentally, an embodiment of the drum unit 518 and the developing unit 641 may be a process cartridge in which the drum unit 518 and the developing unit 641 are integrated.

As illustrated in FIG. 2A, the image forming apparatus 1000 includes the front plate 2001 formed using sheet metal and a rear plate 2002 formed similarly using sheet metal. The front plate 2001 is a side wall that forms a part of the housing of the apparatus body of the image forming apparatus 1000 on the front side (front side) of the apparatus body of the image forming apparatus 1000. The rear plate 2002 is a side wall that forms a part of the housing of the apparatus body of the image forming apparatus 1000 on the rear side (back side) of the apparatus body of the image forming apparatus 1000. As illustrated in FIG. 2A, the front plate 2001 and the rear plate 2002 are arranged to oppose each other, and sheet metal (not illustrated) serving as a beam is bridged between the front plate 2001 and the rear plate 2002. Each of the front plate 2001, the rear plate 2002, and the beam (not illustrated) forms a part of the housing (frame body) of the image forming apparatus 1000.

The opening 2010 is formed in the front plate 2001 such that the drum unit 518 and the developing unit 641 can be inserted and removed into and from the apparatus body along a rotational axis direction of the photosensitive drum from the front side of the image forming apparatus 1000. The drum unit 518 and the developing unit 641 are mounted at predetermined positions of the apparatus body of the image forming apparatus 1000 through the opening 2010. In addition, the image forming apparatus 1000 includes covers 558Y, 558M, 558C, and 558K (hereinafter collectively referred to simply as a "cover 558") that cover the front sides of both the drum unit 518 and the developing unit 641 mounted at the predetermined positions of the apparatus body. The cover 558 has one end, fixed to the apparatus body of the image forming apparatus 1000 by a hinge, so as to be rotatable with respect to the apparatus body of the image forming apparatus 1000 by the hinge. The operator opens the cover 558 to take out the drum unit 518 or the developing unit 641 inside the apparatus body, inserts the new drum unit 518 or developing unit 641, and closes the cover 558, whereby the replacement work is completed.

In the following description, a side of the front plate 2001 is defined as the front side (front side) and a side of the rear plate 2002 is defined as the rear side (back side) with respect to the apparatus body as illustrated in FIGS. 2A and 2B. In addition, a side where the photosensitive drum 103Y on which an electrostatic latent image relating to a yellow toner image is to be formed is arranged is defined as the right side using, as a reference, the photosensitive drum 103K on which an electrostatic latent image relating to a black toner image is to be formed. A side where the photosensitive drum 103K on which the electrostatic latent image relating to the black toner image is to be formed is arranged is defined as the left side using, as a reference, the photosensitive drum 103Y on which the electrostatic latent image relating to the yellow toner image is to be formed. Further, a direction perpendicular to the front-rear direction and the left-right direction defined herein, the direction facing upward in a vertical direction is defined as an upward direction, and a direction perpendicular to the front-rear direction and the left-right direction defined herein, the direction facing downward in the vertical direction is defined as a downward direction. The defined forward direction, backward direction, rightward direction, leftward direction, upward direction, and downward direction are illustrated in FIGS. 2A and 2B. In addition, the rotational axis direction of the photosensitive drum 103 described in the following text is a direction substantially coinciding with the front-rear direction illustrated in FIGS. 2A and 2B.

Figure 3A:
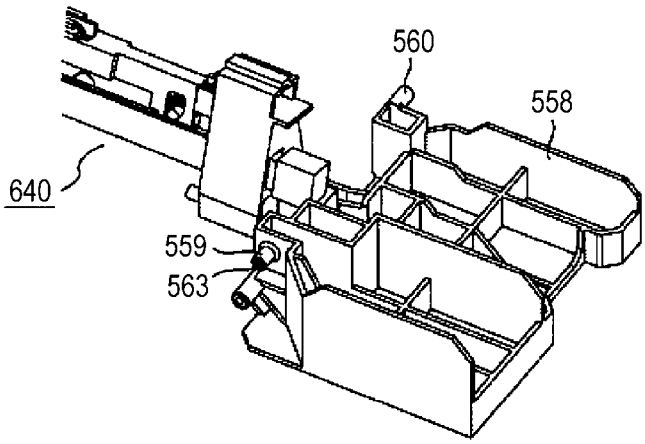
FIGS. 3A to 3D are views illustrating a cover rotatable with respect to the image forming apparatus.

Next, the cover 558 will be described with reference to FIGS. 3A to 3D. FIG. 3A is a perspective view of the cover 558 as viewed from the right side, FIG. 3B is a perspective view of the cover 558 as viewed from the left side, FIG. 3C is a view for describing the front plate 2001 to which the cover 558 has been attached, and FIG. 3D is a view of the front plate 2001 in which the cover 558 is not illustrated.

Figure 3B:
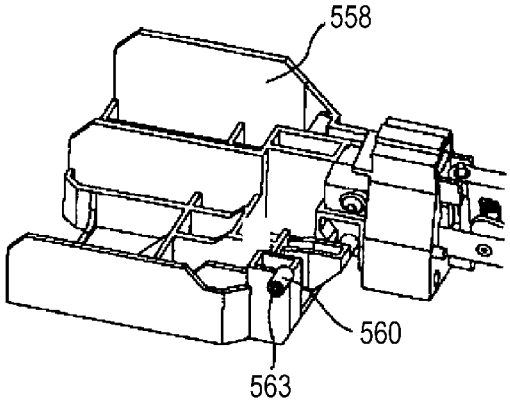
Figure 3C:
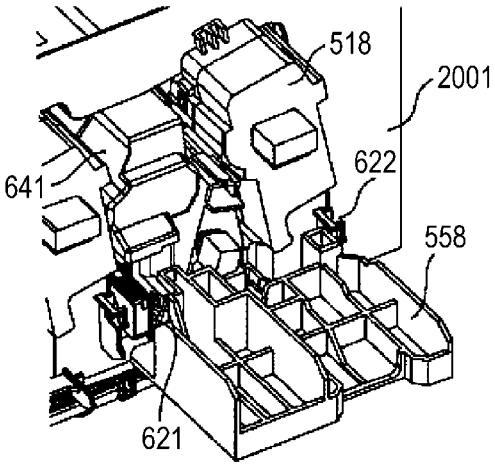

The operator such as a user and a maintenance person can detach the drum unit 518 from the apparatus body by setting the cover 558 in an open state (FIG. 3C). The closed cover 558 is located on an insertion and removal path of the drum unit 518 and the developing unit 641. Thus, it is difficult for the operator to perform the replacement work of the drum unit 518 and the developing unit 641 if the cover 558 is in a closed state. The operator can replace the drum unit 518 by opening the cover 558, and closes the cover 558 after completing the work.

As illustrated in FIGS. 3A and 3B, the cover 558 is provided with rotation shaft portions (559 and 560). The rotation shaft portion 559 is a cylindrical projection that projects to the right side of the cover 558. On the other hand, the rotation shaft portion 560 is a cylindrical projection that projects to the left side of the cover 558. Incidentally, a rotational axis 563 is a rotation center axis of the cover 558 that rotates about the rotation shaft portions (559 and 560).

Figure 3D:
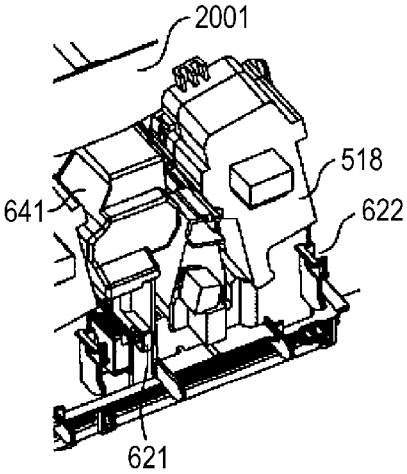

As illustrated in FIGS. 3C and 3D, the front plate 2001 is provided with: a bearing member 621 to which the rotation shaft portion 559 of the cover 558 is fitted; and a bearing member 622 to which the rotation shaft portion 560 is fitted. As illustrated in FIG. 3C, the rotation shaft portion 559 of the cover 558 is rotatably fitted to the bearing member 621 of the front plate 2001, and the rotation shaft portion 560 is rotatably fitted to the bearing member 622 of the front plate 2001.

(Optical Print Head)

Next, the optical print head and peripheral components thereof will be described in detail. Here, there is a laser beam scanning exposure system in which an irradiation beam of a semiconductor laser is scanned with a rotating polygon mirror or the like to expose a photosensitive drum to light through an f-O lens or the like, as an example of an exposure system adopted in an image forming apparatus of an electrophotographic system. The "optical print head 105" described in the embodiment is used for an LED exposure system, which exposes the photosensitive drum 103 to light using light emitting elements such as LEDs arrayed along the rotational axis direction of the photosensitive drum 103, and is not used for the laser beam scanning exposure method described above.

The optical print head 105 described in the embodiment is provided on the lower side in the vertical direction of the rotational axis of the photosensitive drum 103, and an LED 503 of the optical print head 105 exposes the photosensitive drum 103 to light from below. However, the optical print head 105 may be configured to be provided on the upper side in the vertical direction of the rotational axis of the photosensitive drum 103 such that the photosensitive drum 103 is exposed from above.

Figure 4:
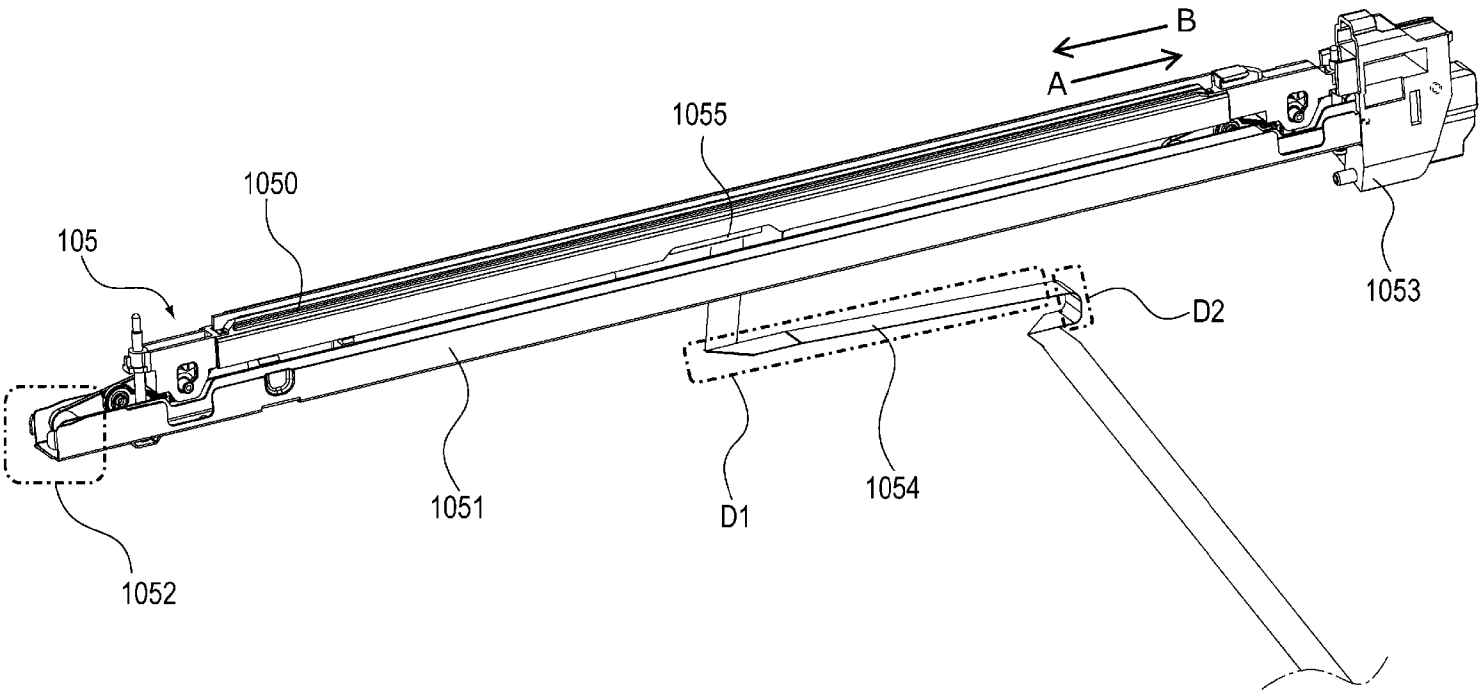
FIG. 4 is a perspective view for describing a configuration of an optical print head.

FIG. 4 is a view for describing a configuration of the optical print head 105. All the four optical print heads 105Y, 105M, 105C, and 105K illustrated in FIG. 1 as the optical print head 105 have the same configuration. As illustrated in FIG. 4, the optical print head 105 includes an exposure portion 1050, a first support member 1051, attachment portions 1052 and 1053, and a cable 1054. The exposure portion 1050 and the first support member 1051 are sometimes collectively referred to simply as the "optical print head 105". The exposure portion 1050 exposes the photosensitive drum 103 to light. The exposure portion 1050 includes: a long substrate in which a plurality of light emitting elements such as light emitting diodes (LEDs) is arranged one-dimensionally (in a straight line) along a longitudinal direction of the optical print head 105; and a lens that collects light from the light emitting elements.

Figure 5A:
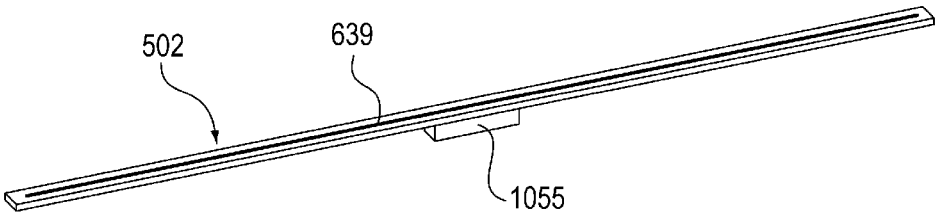
FIGS. 5A to 5C are views illustrating a substrate in an optical print head.
Figure 5B:
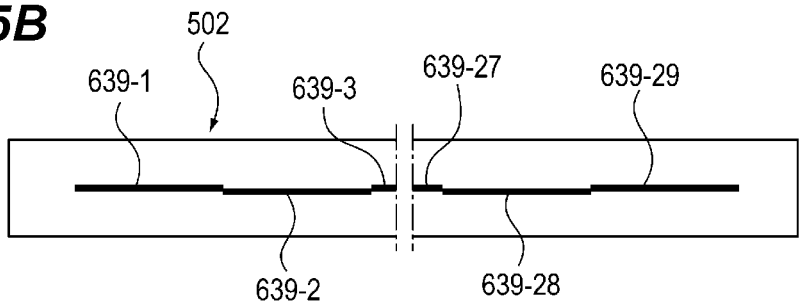
Figure 5C:
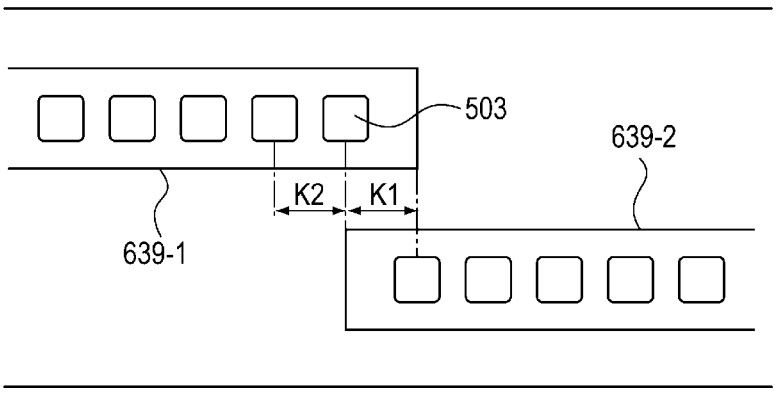

Here, the long substrate on which the plurality of light emitting elements is arranged, and a lens array including the lens, which are included in the exposure portion 1050, will be described. First, the substrate of the exposure portion 1050 will be described. FIG. 5A is a schematic perspective view of a substrate 502. FIG. 5B is a view for describing an LED chip 639 mounted on the substrate 502. FIG. 5C is an enlarged view of FIG. 5B, and is the view illustrating a plurality of the LEDs 503 (an example of the light emitting element) provided on the LED chip 639.

As illustrated in FIG. 5A, the LED chip 639 is provided on one surface of the substrate 502, and a long connector 1055 is provided on the other surface (a surface opposite to the side where the light emitting elements are arrayed). The connector 1055 is attached to a lower surface of the substrate 502 such that a longitudinal direction thereof extends along a longitudinal direction of the substrate 502. The substrate 502 is provided with a wiring configured to supply a signal to each of the LED chips 639. As illustrated in FIG. 4, one end (connecting portion) of a flexible flat cable (a cable in which a plurality of flat conductors is covered with a film-shaped insulator), which is an example of the cable 1054, is connected to the connector 1055.

Incidentally, the cable 1054 connected to the connector 1055 on one end side thereof is wired to the front plate side which is the front side of the apparatus body, and is regulated from moving to the front side of the apparatus body or to the back side of the apparatus body by a regulating portion to be described later. This regulating portion will be described later.

The apparatus body of the image forming apparatus 1000 is provided with a substrate including a controller (not illustrated) and a connector (not illustrated). The other end side of the cable wired to the front side of the apparatus body through the regulating portion is connected to be detachably attachable a connector of the substrate provided in the apparatus body. That is, the cable connects the connector on the apparatus body side and the connector 1055 on the optical print head side, and electrically connects the controller of the image forming apparatus and the substrate 502 of the optical print head. A control signal (drive signal) is input to the substrate 502 of the exposure portion 1050 from the controller (not illustrated) of the apparatus body of the image forming apparatus 1000 via the cable 1054 and the connector 1055. The LED chip 639 is driven by the control signal input to the substrate 502.

The LED chip 639 mounted on the substrate 502 will be described in more detail. As illustrated in FIGS. 5B and 5C, a plurality of (29) LED chips 639-1 to 639-29 on which the plurality of LEDs 503 is arranged is arrayed on one surface of the substrate 502. On each of the LED chips 639-1 to 639-29, 516 LEDs 503 are arrayed in a row in the longitudinal direction thereof. In the longitudinal direction of the LED chip 639, a distance k2 between centers of the adjacent LEDs 503 corresponds to the resolution of the image forming apparatus. Since the resolution of the image forming apparatus of the embodiment is 1200 dpi, the LEDs 503 are arrayed in a row such that the distance between the centers of the adjacent LEDs 503 is 21.16 μm in the longitudinal direction of the substrate 502 on the LED chips 639-1 to 639-29. Thus, an exposure range of the optical print head 105 of the embodiment is about 314 mm. A photosensitive layer of the photosensitive drum 103 is formed to have a width of 314 mm or larger. Since a length of a long side of an A4-size recording sheet and a length of a short side of an A3-size recording sheet are 297 mm, the optical print head 105 of the embodiment has an exposure range enabling image formation on the A4-size recording sheet and the A3-size recording sheet.

The LED chips 639-1 to 639-29 are alternately arranged in two rows along the rotational axis direction of the photosensitive drum 103. That is, as illustrated in FIG. 5B, the odd-numbered LED chips 639-1, 639-3, . . . , and 639-29 counted from the left side are mounted in a row in the longitudinal direction of the substrate 502, and the even-numbered LED chips 639-2, 639-4, . . . , and 639-28 are mounted in a row in the longitudinal direction of the substrate 502. Since the LED chips 639 are arranged in this manner, the distance k1 between the centers of the LEDs arranged at one end of one LED chip 639 and the other end of the other LED chip 639 in the different LED chips 639 adjacent to each other can be set to equal to a distance k2 between centers of adjacent LEDs 503 on the single LED chip 639 in the longitudinal direction of the LED chip 639 as illustrated in FIG. 5C. Although the configuration using the LED 503 as an exposure light source is exemplified in the embodiment, an organic electro luminescence (organic EL) may be used as the exposure light source.

Figure 5D:
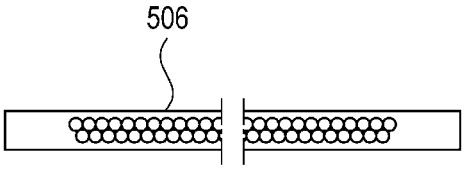
FIGS. 5D and 5E are views illustrating a lens array.
Figure 5E:
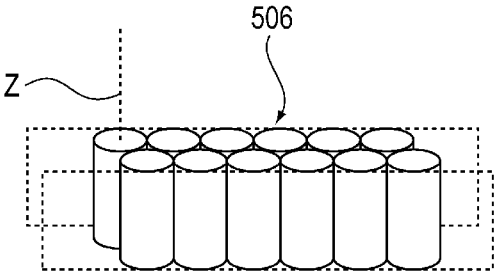

Next, the lens array 506 will be described. FIG. 5D is a schematic view of the lens array 506 as viewed from a side of the photosensitive drum 103. FIG. 5E is a schematic perspective view of the lens array 506. As illustrated in FIGS. 5D and 5E, a plurality of lenses is arrayed in two rows along an array direction of the plurality of LEDs 503. The respective lenses are alternately arranged such that one of lenses in one row is arranged so as to be in contact with both of two lenses adjacent to each other in an array direction of lenses in the other row. Each of the lenses is a rod lens having a cylindrical shape and made of glass. Incidentally, a material of the lens is not limited to glass, but may be plastic. A shape of the lens is not limited to the cylindrical shape, and may be a polygonal prism such as a hexagonal prism.

Radiation light emitted from the LED 503 is incident on the lens of the lens array 506. The lens has a function of collecting the incident radiation light onto the surface of the photosensitive drum 103. The optical print head 105 is assembled such that a distance between a light emitting surface of the LED 503 and a light incident surface of the lens and a distance between a light emitting surface of the lens and the surface of the photosensitive drum 103 become substantially equal.

Figure 7:
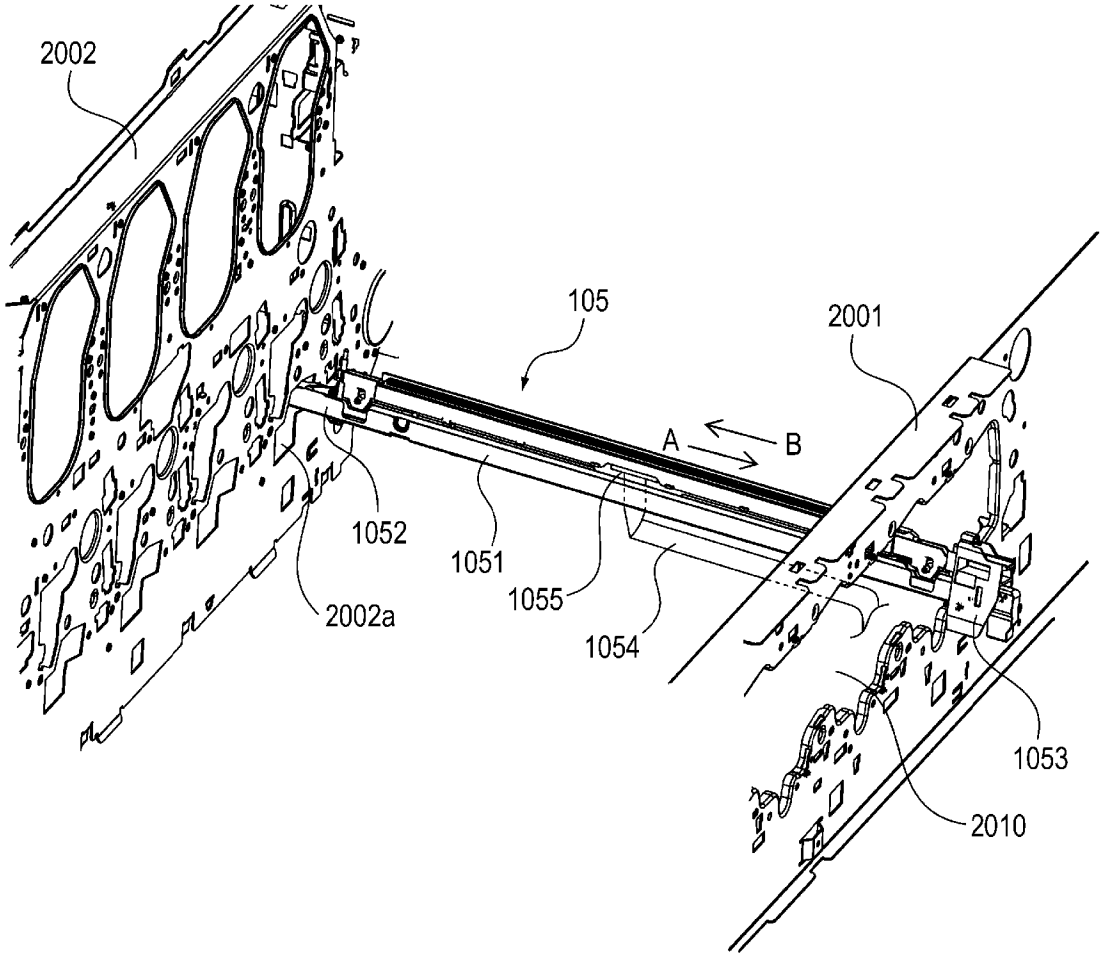
FIG. 7 is a perspective view illustrating a state where the optical print head is accommodated in the image forming apparatus.

As illustrated in FIGS. 2A, 2B, and 7, the cable 1054 connected to the connector 1055 on one end side thereof is wired along the optical print head 105 from the connector 1055 toward the one end side of the optical print head 105 in the rotational axis direction of the photosensitive drum 103.

In addition, the first support member 1051 is an elongated member that supports the long substrate on which the light emitting element (LED) is arranged. The first support member 1051 is a member that supports the exposure portion 1050 in the longitudinal direction of the exposure portion 1050 and has a concave-shaped cross-sectional shape, and is formed using sheet metal in the embodiment.

(Substrate Configuration to Control Optical Print Head)

Figure 6:
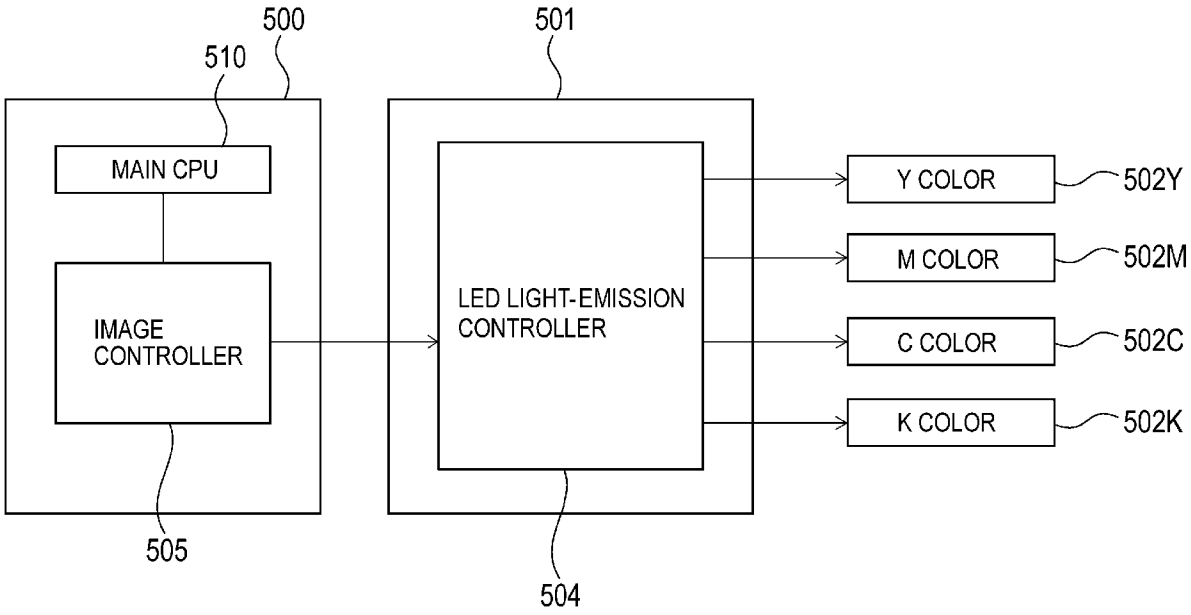
FIG. 6 is a block diagram illustrating a substrate configuration to control the optical print head.

Here, a substrate configuration to control the optical print head will be described with reference to FIG. 6. FIG. 6 illustrates a control block diagram. The substrate configuration to control the optical print head 105 in the embodiment includes a body substrate 500, an LED control board 501, and printed boards 502 (Y, M, C, and K) on which a plurality of light emitting elements such as LEDs and a lens array are mounted.

The body substrate 500 is a printed board which controls each portion of the apparatus body during image formation. The body substrate 500 includes a main CPU (controller) 510, and controls each portion of the apparatus body by the main CPU 510. In addition, the body substrate 500 includes an image controller 505 which performs image processing, and outputs image data that needs to be formed to an LED light emission controller 504 when receiving an image formation instruction from the main CPU 510.

The image data includes a plurality of pieces of unit image data corresponding to the plurality of LED elements (light emitting elements) included in the printed board 502 on which the plurality of light emitting elements and the lens array are mounted. The image controller 505 outputs the image data to the LED light emission controller 504 in a predetermined order.

The LED light emission controller 504 generates irradiation data using the image data output from the image controller 505. The image data from the image controller 505 contains color information on which color the image is, and the LED light emission controller 504 transmits irradiation data corresponding to each color to the printed board 502 on which an LED element group of each color has been mounted, based on the color information. The LED element is turned on to irradiate the photosensitive drum with light based on the irradiation data transmitted to the printed board 502.

Here, the LED control board 501 also has a function as a relay substrate configured to electrically connect the body substrate 500 and the printed board 502.

(Attachment Configuration of Optical Print Head with Respect to Image Forming Apparatus)

FIG. 7 is a perspective view illustrating a state where the optical print head 105 is accommodated in the image forming apparatus 1000. Regarding the housing of the image forming apparatus 1000, only the main parts of the front plate 2001 and the rear plate 2002 as each part of the housing are illustrated.

As illustrated in FIG. 7, the opening 2010 is formed in the front plate 2001 on the front side of the apparatus body of the image forming apparatus 1000. The optical print head 105 is movable to a mounting position where the optical print head 105 has been mounted on the apparatus body so as to expose the photosensitive drum 103 to light and a pull-out position where optical print head 105 has been pulled out from the mounting position toward the front side by the operator. The optical print head 105 located at the mounting position is moved by the operator in the direction of the arrow A in FIG. 7 to move to the pull-out position. On the other hand, the optical print head 105 located at the pull-out position is moved by the operator in the direction of the arrow B in FIG. 7 to move to the mounting position. The operator can attach or detach the optical print head 105 to or from the image forming apparatus 1000 by inserting or removing the optical print head 105 in the rotational axis direction of the photosensitive drum 103 from the back side to the front side of the apparatus body (in the direction of the arrow A) or from the front side to the back side (the direction of the arrow B) through the opening 2010. When it is necessary to replace the optical print head 105 or the maintenance work is required, the operator pulls out the optical print head 105 located at the mounting position to the pull-out position and works.

The front plate 2001 and the rear plate 2002 are the parts of the housing of the image forming apparatus 1000 and support one end side and the other end side of the optical print head 105 located at the mounting position, respectively.

The front plate 2001 supporting one end portion in the longitudinal direction of the optical print head 105 is arranged on the front side of the image forming apparatus 1000. The rear plate 2002 supporting the other end portion in the longitudinal direction of the optical print head 105 is arranged on the back side of the image forming apparatus 1000.

Figure 8A:
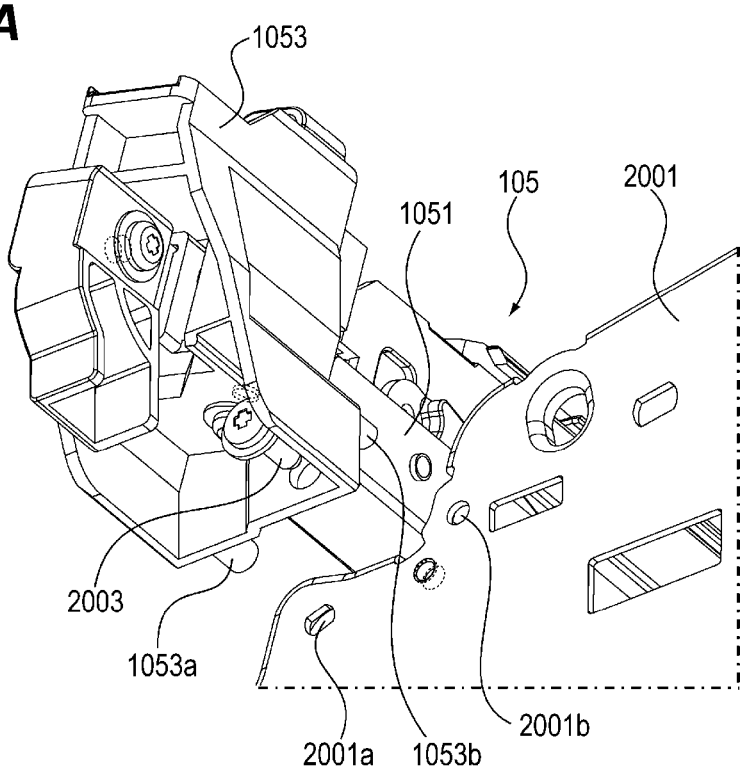
FIGS. 8A and 8B are exploded perspective views illustrating an engagement relationship between the optical print head and the image forming apparatus.
Figure 8B:
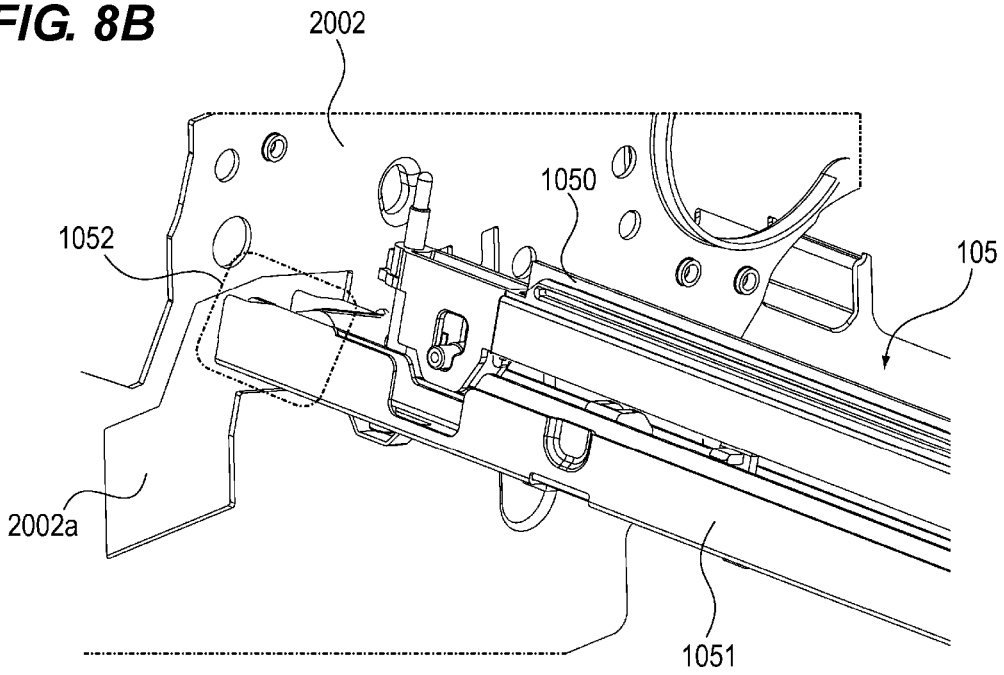

FIG. 8A is an enlarged perspective view of the attachment portion 1053 of the optical print head 105. FIG. 8B is an enlarged perspective view of the attachment portion 1052 of the optical print head 105. As illustrated in FIGS. 8A and 8B, the attachment portion 1052 and the attachment portion 1053 are attachment members configure to attach and fix the optical print head 105 to the front plate 2001 and the rear plate 2002 which form the parts of the housing of the image forming apparatus 1000.

As illustrated in FIG. 8B, the attachment portion 1052 is inserted into a hole (an example of a positioning hole) 2002*a* provided in the rear plate 2002. As the attachment portion 1052 is inserted into a hole 2002*a* provided in the rear plate 2002, the optical print head 105 is accommodated inside the image forming apparatus 1000. In other words, the optical print head 105 is positioned with respect to the rear plate 2002 as the back side of the optical print head 105 (the other end side of the optical print head 105 in the longitudinal direction of the optical print head 105) is fitted to the hole 2002*a*.

As illustrated in FIG. 8A, the attachment portion 1053 has a projection 1053*a* and a projection 1053*b* to be inserted into holes 2001*a* and holes 2002*b* provided in the front plate 2001. As the projections 1053*a* and 1053*b* of the attachment portion 1053 are inserted into the holes 2001*a* and 2001*b* provided in the front plate 2001, the position of the optical print head 105 is determined with respect to the image forming apparatus 1000.

After being positioned with respect to the image forming apparatus 1000, the optical print head 105 is fastened to the front plate 2001 by a small screw 2003 and fixed with respect to the image forming apparatus 1000 as illustrated in FIG. 8A. When fastening the optical print head 105 to the front plate 2001, a fastening unit thereof is not limited to the small screw 2003. Instead of the small screw 2003, for example, a screw may be used. However, the small screw or the screw, which can be easily attached and detached with a screwdriver or the like, is ideal when considering that it is desirable that fastening of the optical print head 105 with respect to the front plate 2001 be easily releasable by the operator. Incidentally, the optical print head 105 is fastened to the front plate 2001 only at one point using the small screw 2003 in FIG. 8A, but may be fastened at a plurality of points.

(Second Support Member (Support Member))

Figure 9:
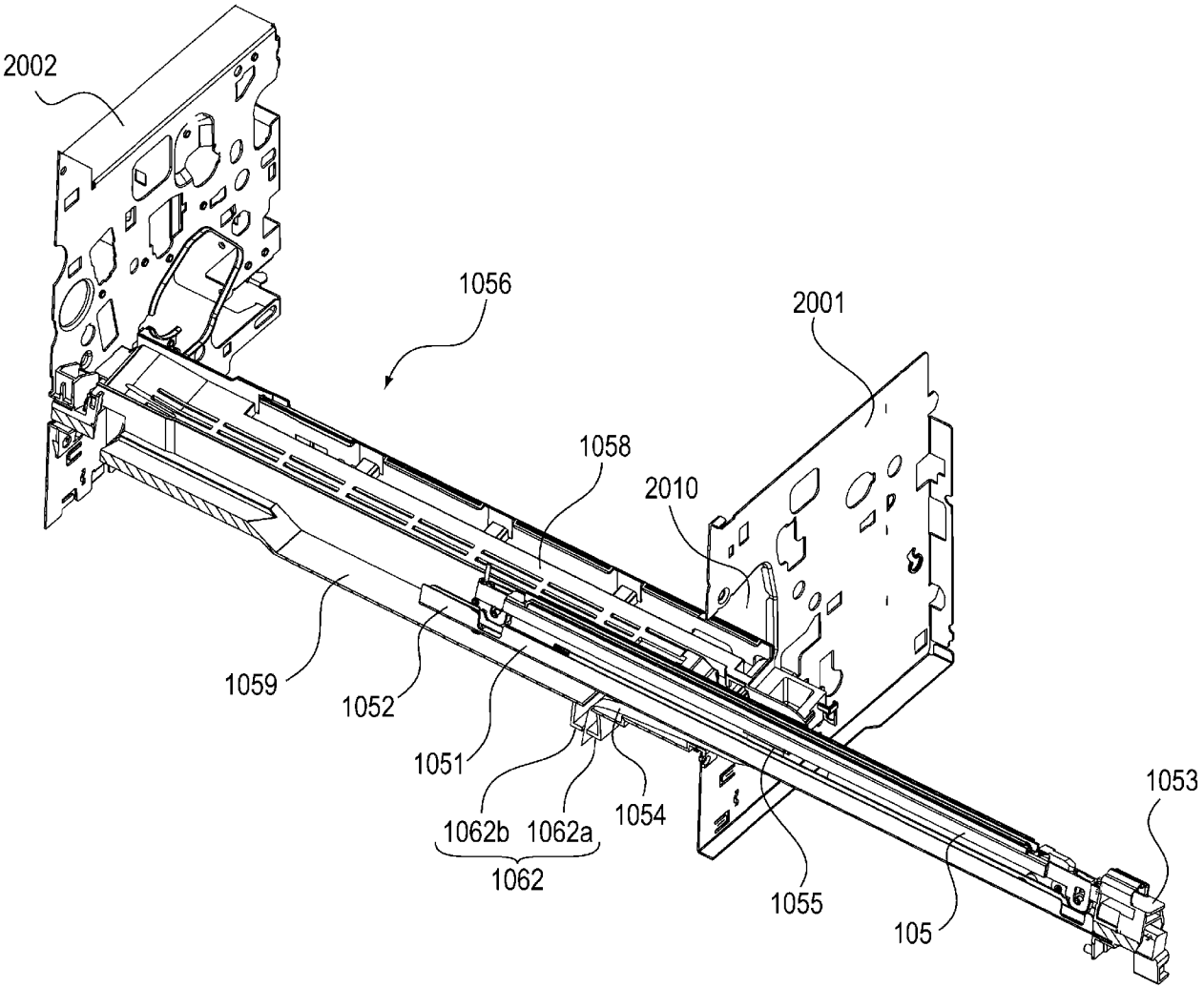
FIG. 9 is a perspective view illustrating a second support member.

FIG. 9 is a view illustrating a state where the optical print head 105 is pulled out from a second support member (support member) 1056, and is the view illustrating a state where the connector 1055 and the cable 1054 are exposed to the outer side of the opening 2010. As illustrated in FIG. 9, one end side (the front side of the apparatus body) of the second support member 1056 is fixed to the front plate 2001 by a small screw or the like. Further, the other end side (the back side of the apparatus body) of the second support member 1056 is fixed to the rear plate 2002 with a small screw or the like. The second support member 1056 has a function of guiding the movement of the optical print head 105 inserted into the apparatus body from the outer side of the apparatus body through the opening 2010 formed in the front plate 2001. In other words, the second support member 1056 has a function of guiding the movement of the optical print head 105 moving from the pull-out position to the mounting position or from the mounting position to the pull-out position. The optical print head 105 is supported from the lower side to the upper side in the vertical direction by the second support member 1056 in the middle of being moved by the operator from the pull-out position (or the mounting position) to the mounting position (or the pull-out position). Here, the optical print head 105 in the state of being located at the mounting position is positioned and supported only by the front plate 2001 and the rear plate 2002 in the embodiment. Thus, the optical print head 105 located at the mounting position is not supported by the second support member 1056. This aims to position the optical print head 105 with respect to the photosensitive drum 103 more accurately. If the optical print head 105 is positioned with respect to the second support member 1056 which is fixed to the front plate 2001 and the rear plate 2002, the optical print head 105 is positioned by the front plate 2001 and the rear plate 2002 with a certain extra member (the second support member 1056 in this case) interposed therebetween. Incidentally, the second support member 1056 is arranged inside the apparatus body so as to correspond to each of the four image forming portions 102Y, 102M, 102C, and 102K.

As illustrated in FIG. 9, the second support member 1056 includes a guide portion 1058 and a guide portion 1059. The guide portion 1058 has a function of guiding the movement of the drum unit 518 (see FIGS. 2A and 2B) inserted toward the inside of the apparatus body through the opening 2010 of the front plate 642. A shape of the guide portion 1058 has a shape that follows a shape of a lower portion of the drum unit 518. Thus, the drum unit 518 inserted from the front side to the back side of the apparatus body through the opening 2010 of the front plate 2001 is fitted to the guide portion 1058 with a slight margin. The operator further pushes the drum unit 518 from the front side to the back side of the apparatus body in a state where the lower portion of the drum unit 518 is fitted to the guide portion 1058. Then, the drum unit 518 moves along the guide portion 1058 from the front side to the back side of the apparatus body, and is mounted to the apparatus body.

On the other hand, the guide portion 1059 has a function of guiding the movement of the optical print head 105 inserted toward the inside of the apparatus body through the opening 2010 of the front plate 642. When there is a malfunction or the like of the substrate 502, the optical print head 105 needs to be replaced or repaired for maintenance thereof. Thus, it is necessary for the optical print head 105 to adopt a configuration that can be replaced with respect to the image forming apparatus 1000.

A shape of the guide portion 1059 has a shape that follows a lower portion of the first support member 1051. Thus, the optical print head 105 inserted from the front side to the back side of the apparatus body through the opening 2010 of the front plate 2001 is fitted to the guide portion 1059 with a slight margin. The operator further pushes the optical print head 105 from the front side to the back side of the apparatus body in a state where the lower portion of the optical print head 105 is fitted to the guide portion 1059. Then, the optical print head 105 moves along the guide portion 1059 from the front side to the back side of the apparatus body, and the attachment portion 1052 of the first support member 1051 is fitted into the hole 2002*a* formed in the rear plate 2002. That is, the operator can cause the attachment portion 1052 to be reliably fitted in the hole 2002*a* merely by moving the optical print head 105 from the front side to the back side of the apparatus body in the state of being fitted to the guide portion 1059.

(Regulating Portion)

Next, a function of a regulating portion 1062 provided on the lower side of the second support member 1056 will be described. As illustrated in FIG. 9, the regulating portion 1062 includes a first wall portion 1062*a* and a second wall portion 1062*b*. The regulating portion 1062 is a member that holds the cable 1054, which is wound from the upper side of the second support member 1056 toward the lower side of the second support member 1056 via a hole 1056*a*, by sandwiching the cable 1054 from the front side and the back side thereof by the first wall portion 1062*a* and the second wall portion 1062*b*. The cable 1054 is nipped between the first wall portion 1062*a* and the second wall portion 1062*b* to be in the state of being attached to the second support member 1056. The first wall portion 1062*a* has elasticity, and a distal end (a part that is brought into contact with the cable 1054) of the first wall portion 1062*a* is constantly biased against the second wall portion 1062*b*. Thus, the cable 1054 is interposed between the first wall portion 1062*a* and the second wall portion 1062*b* such that the movement of the apparatus body from the front side to the back side and the movement of the apparatus body from the front side to the back side are regulated. Incidentally, the configuration of the regulating portion 1062 is not limited to the above configuration. A configuration in which the second wall portion 1062*b* has elasticity, that is, the configuration in which the second wall portion 1062*b* is biased against the first wall portion 1062*a* may be adopted, or a configuration in which both the wall portions are biased against each other may be adopted. Alternatively, for example, a structure in which the second wall portion 1062*b* is removed and the first wall portion 1062*a* is biased toward the lower side of the second support member 1056 may be adopted. In this case, the cable 1054 is attached to the second support member 1056 by being sandwiched between the first wall portion

1062*a* and the lower side of the second support member 1056. In the embodiment, the cable 1054 is nipped between the first wall portion 1062*a* and the second wall portion 1062*b*, but can move in the interposed state. As the function of the regulating portion 1062, it is sufficient if the movement of a part of the cable 1054 from the back side to the front side of the apparatus body is regulated. Thus, the cable 1054 may be fixed to the regulating portion 1062 by an adhesive, a double-sided tape, or the like, or is not necessarily fixed.

The regulating portion 1062 is not necessarily provided on the second support member 1056. The regulating portion 1062 may be provided on any place as long as the regulating portion 1062 is provided on the back side of the apparatus body of the front plate 2001 and on the front side of the apparatus body of the rear plate. Examples of the place where the regulating portion 1062 is provided include the back side of the front plate 2001 and the front side of the rear plate 2002. When the relay substrate to which the other end side of the cable 1054 is connected is arranged on the back side of the apparatus body of the rear plate 2002, the cable 1054 extending from the relay substrate is wound on the front side of the rear plate 2002 through the hole formed in the rear plate 2002. The cable 1054 extending from the hole formed in the rear plate 2002 to the front side is connected to the connector 1055 of the optical print head 105 through the hole 1056*a* formed in the second support member 1056. In such a case, the hole which is formed in the rear plate 2002 and through which the cable 1054 passes may be used as the regulating portion 1062. In addition, the hole 1056*a* may also serve the effect of the regulating portion 1062 as described above.

(Contact Portion)

Figure 10:
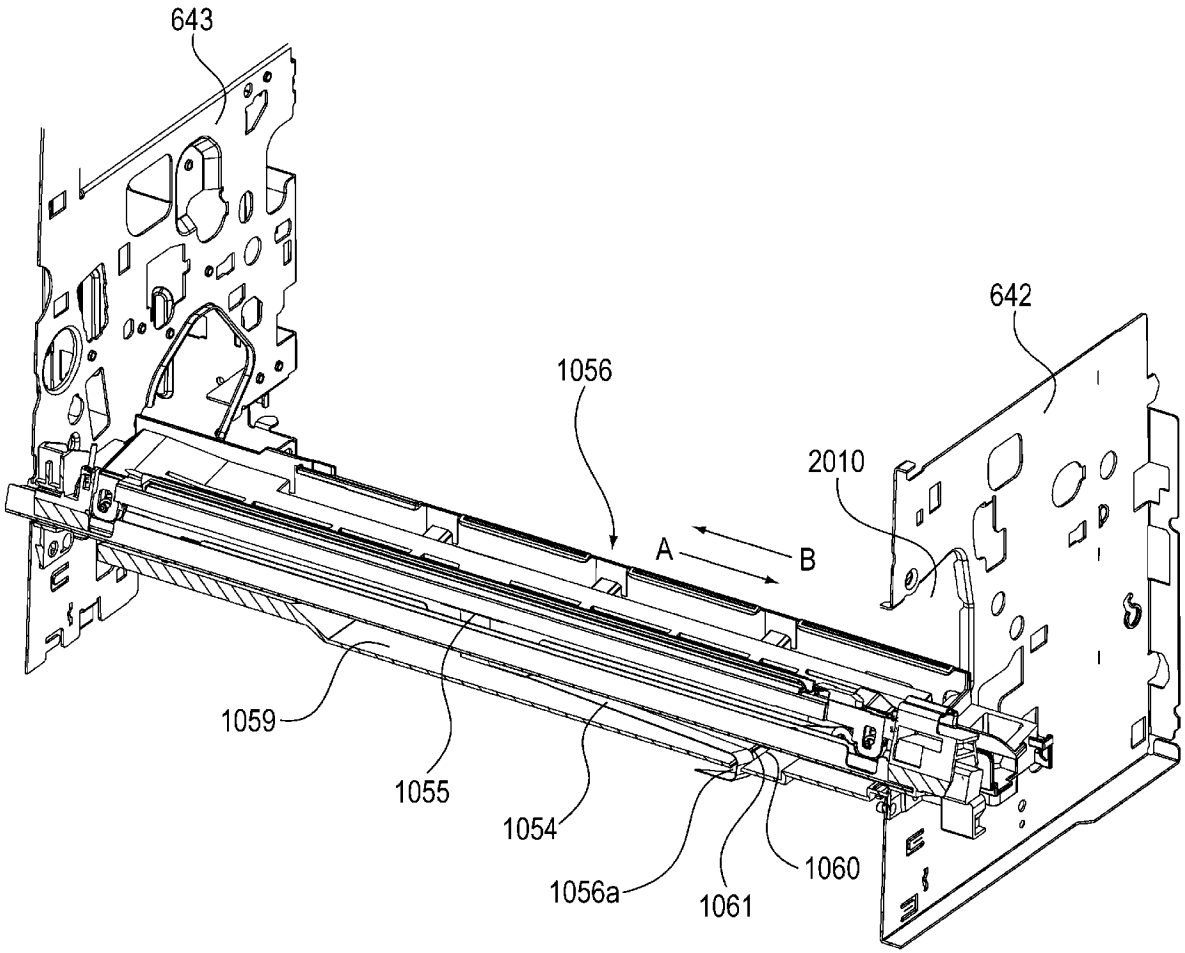
FIG. 10 is a perspective view of a cross section of the second support member taken in a vertical direction along a rotational axis direction of a photosensitive drum.

FIG. 10 is a perspective view of a cross section of the second support member 1056 taken in the vertical direction along the rotational axis direction of the photosensitive drum. As illustrated in FIG. 10, the hole 1056*a* through which the cable 1054 passes is formed on the front side (front side of the apparatus body) of the guide portion 1059. Since a part of the cable 1054 is brought into contact with an edge of the hole 1056*a*, the cable 1054 is regulated from moving to the front side of the apparatus body or to the back side of the apparatus body. The cable 1054 extending from the connector 1055 toward the hole 1056*a* on the upper side in the vertical direction of the second support member 1056 is wired toward the lower side in the vertical direction of the second support member 1056 through the hole 1056*a*. Incidentally, the hole 1056*a* referred to herein may have any function as long as the hole 1056*a* has a function of causing the cable 1054 to pass from the upper side to the lower side of the second support member 1056. Thus, not only the hole but also a notch shape in which a part of the edge is not connected may be used.

The hole 1056*a* has a first wall portion (contact portion) 1060 on the front side thereof and a second wall portion 1061 on the rear side in insertion and removal directions (directions of the arrows A and B) of the optical print head 105 with respect to the apparatus body. The cable 1054 opposes both the first wall portion 1060 and the second wall portion 1061 in the front-rear direction. In the embodiment, a gap is formed between the cable 1054 and the first wall portion 1060 in the front-rear direction. Similarly, a gap is also formed between the cable 1054 and the second wall portion 1061 in the front-rear direction. That is, the cable 1054 only passes through the hole 1056*a* and is not fixed with respect to the edge of the hole 1056*a*. Thus, the cable 1054 is allowed to move within an interval between the first wall portion 1060 and the second wall portion 1061. In the embodiment, the interval between the first wall portion 1060 and the second wall portion 1061 is about 5 mm. As illustrated in FIG. 10, when the optical print head 105 is located at the mounting position, the cable 1054 extending from the connector 1055 to the front side on the upper side of the second support member 1056 passes through the hole 1056*a* and is folded back, and is wound toward the back side of the apparatus body on the lower side of the second support member 1056. In other words, the hole 1056*a* is formed in the second support member 1056 so as to be on the front side of the connector 1055 of the optical print head 105 located at the mounting position. However, a position where the hole 1056*a* is formed in the second support member 1056 may be a position on the back side of the connector 1055 when the optical print head 105 is located at the mounting position. In this case, the cable 1054 is wound toward the back side of the apparatus body from the connector 1055 on the upper side of the second support member 1056, and passes through the hole 1056*a*. With the above-described configuration, the cable 1054 is kept in the state of being held by the second support member 1056.

In a state where the optical print head 105 is mounted to the apparatus body (a state where the attachment portion 1052 is fitted in the hole 2002*a*), the cable 1054 having the connecting portion (one end side of the cable 1054) connected to the connector 1055 of the substrate 502 is located between the second support member 1056 and the first support member 1051 and is wired toward the front side of the apparatus body along the longitudinal direction of the optical print head 105. The cable 1054 is wired toward the lower side in the vertical direction of the second support member 1056 through the hole 1056*a*. The other end side of the cable 1054 is connected to, for example, the relay substrate (not illustrated) provided on the back side of the front plate 2001. Although not illustrated, the cables 1054 extending from the optical print heads 105 of the respective four image forming portions are connected to the relay substrate.

In the state where the optical print head 105 is mounted to the apparatus body, the connector 1055 of the substrate 502 is located on the back side of the apparatus body of the hole 1056*a*. That is, the connector 1055 is located on the back side of the apparatus body of the first wall portion (contact portion) 1060. At this time, the cable 1054 extending from the lower side in the vertical direction of the second support member 1056 toward the connector 1055 through the hole 1056*a* is brought into contact with the second wall portion 1061 and is set to the state of being folded back toward the back side of the apparatus body with the second wall portion 1061 as a fulcrum. In other words, at this time, the cable 1054 is bent toward the back side of the apparatus body in the hole 1056*a*.

Figure 11:
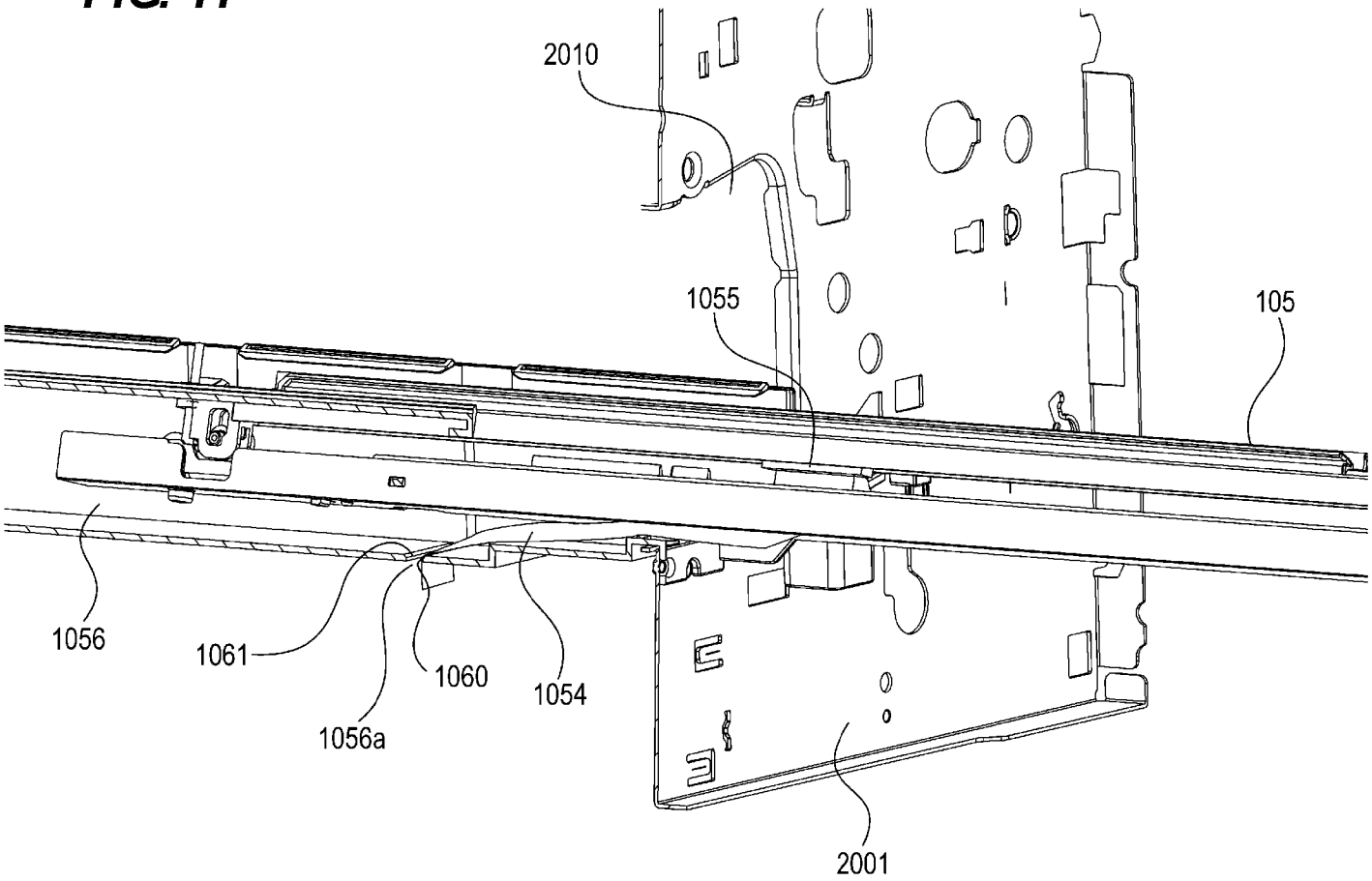
FIG. 11 is a perspective view illustrating a state where the optical print head is taken out from the image forming apparatus.

FIG. 11 illustrates a state where the operator has pulled out the optical print head 105 from the mounting position to the pull-out position. When the optical print head 105 is located at the pull-out position, the connector 1055 of the substrate 502 is located on the front side of the apparatus body of the hole 1056*a*. At this time, the cable 1054 extending from the lower side in the vertical direction of the second support member 1056 toward the opening 2010 of the front plate 2001 through the hole 1056*a* is brought into contact with the first wall portion (contact portion) 1060 and is set to the state of being folded back toward the front side of the apparatus body with the first wall portion 1060 as a fulcrum. In other words, at this time, the cable 1054 is bent toward the front side of the apparatus body in the hole

1056*a*. That is, the direction in which the cable 1054 is folded back with the hole 1056*a* (the first wall portion 1060 or the second wall portion 1061) as the fulcrum is different between the state where the optical print head 105 is mounted to the apparatus body and the state where the optical print head 105 is detached from the apparatus body.

Although the gaps are formed between the first wall portion 1060 and the cable 1054 and between the second wall portion 1061 and the cable 1054, respectively, in the embodiment, the configurations of the cable 1054 and the hole 1056*a* are not limited to the embodiment. For example, it may be configured such that the cable 1054 is nipped between the first wall portion 1060 and the second wall portion 1061 and fixed to the edge of the hole 1056*a*. That is, the first wall portion 1060 and the second wall portion 1061, which are the parts of the edge of the hole 1056*a*, may also serve as the function of the regulating portion 1062 (see FIGS. 11 to 12C) to be described later.

Next, a length of the cable 1054 between the hole 1056*a* and the connector 1055 and a length of a distance between the hole 1056*a* and the opening 2010 of the front plate 2001 in a state where the optical print head 105 is mounted inside the apparatus body will be described with reference to FIGS. 12A to 12C.

Figure 12A:
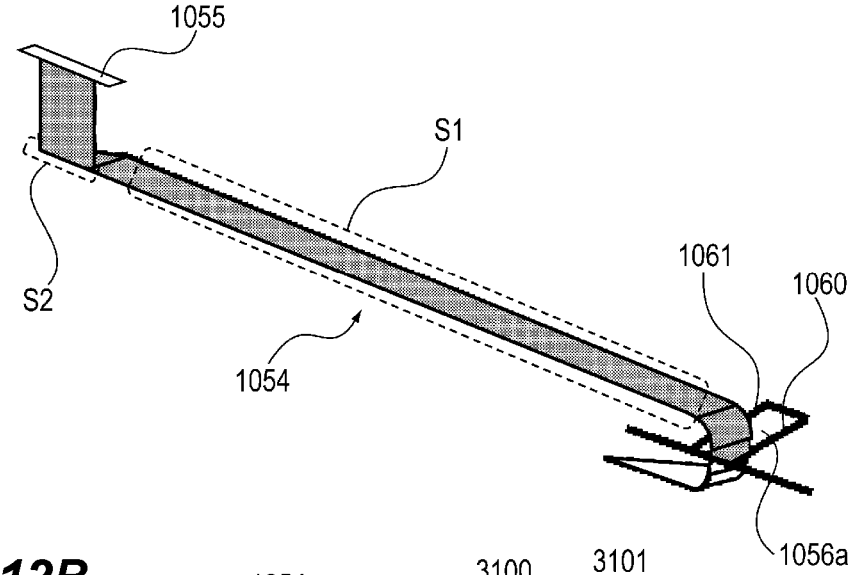
FIGS. 12A to 12C are views for describing a length of a cable between a connector of the optical print head and a regulating portion.

FIG. 12A is a view obtained by removing parts other than the cable 1054 from FIG. 10. As illustrated in FIG. 12A, the cable 1054 extending upward from the hole 1056*a* is wired toward the connector 1055. An area 51 of the cable 1054 is wired along the first support member 1051 of the optical print head 105 toward the front side of the apparatus body and opposes a lower surface of the first support member 1051. The cable 1054 extending toward the connector 1055 is folded upward at a substantially right angle in a part illustrated in an area S2. As a result, the cable 1054 wired along the first support member 1051 of the optical print head 105 is connected to the connector 1055.

Figure 12B:
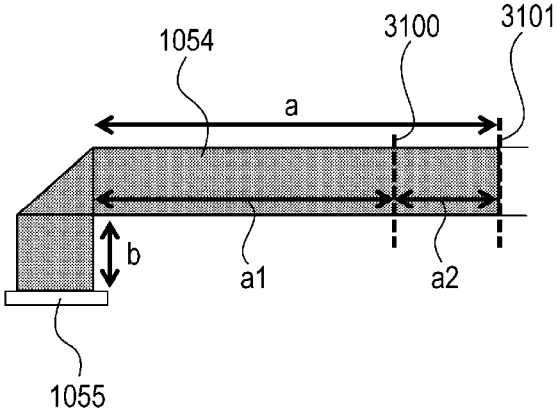

FIG. 12B is a view illustrating a state where the folding (in the area S2) of the cable 1054 illustrated in FIG. 12A is released and extended. FIG. 12C is a cross-sectional view of the front side of the second support member 1056 and the opening 2010 of the front plate 2001 taken in the vertical direction along the rotational axis direction of the photosensitive drum in a state where the optical print head 105 is pulled out from the second support member 1056. In FIG. 12B, a part indicated by a dotted line 3100 is a part of the cable 1054 which is in contact with the edge of the hole 1056*a* (the first wall portion (contact portion) 1060 or the second wall portion 1061). In FIG. 12B, a part indicated by a dotted line 3101 is a part of the cable 1054 which is in contact with the regulating portion 1062. In FIG. 12B, a length of a part indicated by an arrow a1 indicates a length from a part where the cable 1054 extending downward from the connector 1055 is folded back toward the front side of the apparatus body to a part where the cable 1054 is in contact with the edge (first wall portion (contact portion) 1060) of the hole 1056*a*. In FIG. 12B, a length of a part indicated by an arrow a2 indicates a length from the portion where the cable 1054 is in contact with the first wall portion 1060 to a part nipped by the regulating portion 1062. A length of an arrow b in FIG. 12B is a length from a part (the connecting portion: one end side of the cable 1054) connected to the connector 1055 to a part where the cable 1054 extending downward from the connector 1055 is folded back toward the front side of the apparatus body. That is, a sum of the length of the cable 1054 in the part indicated by the arrow a and the length of the cable 1054 in the part indicated by the arrow b, which is the sum of the arrow a1 and the arrow b1, is the shortest length of the cable 1054 from the regulating portion 1062 to the connector 1055.

Figure 12C:
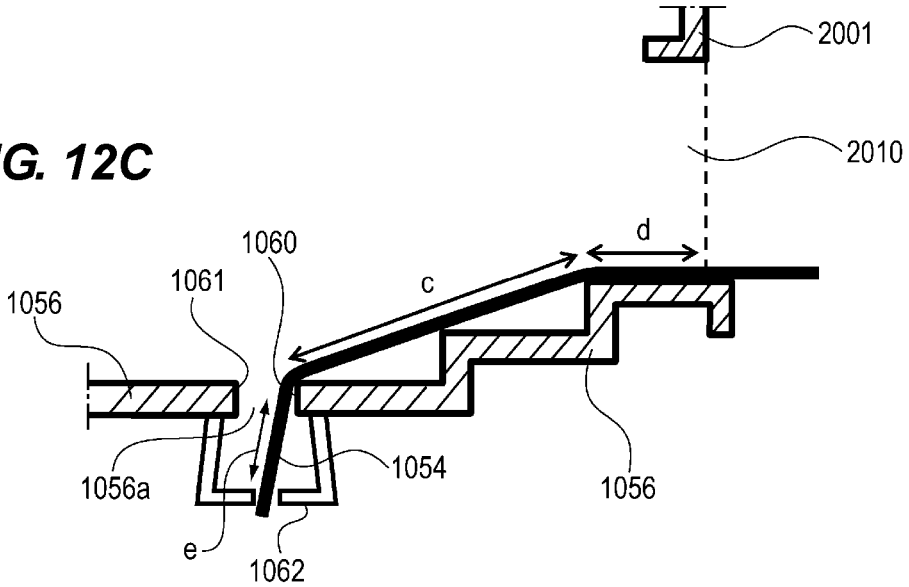

In FIG. 12C, the cable 1054 is folded toward the front side of the apparatus body with the first wall portion 1060 of the hole 1056*a* as a fulcrum since the optical print head 105 is in the state of being pulled out from the second support member 1056. In this state, the cable 1054 is stretched without curving. Here, a sum of a length c, a length d, and a length e, which is the length of the cable 1054 from the hole 1056*a* to the opening 2010, is defined as the distance (shortest distance) between the hole 1056*a* and the opening 2010 as illustrated in FIG. 12C. Even in the case where an upper surface of the second support member 1056 has, for example, a stepped shape as illustrated in the example of FIG. 12C, the shortest distance can be obtained by bringing the side of the connecting portion of the cable 1054 (the side connected to the connector 1055) into contact with the edge of a lower end of the opening 2010 to be pulled to the front side. In other words, the distance from the regulating portion 1062 to the opening 2010 when the cable 1054 is pulled from the back side toward the front side, from the front side of the opening 2010 in a state where the cable 1054 is nipped by the regulating portion 1062 so that the curving of the cable 1054 disappears is the "shortest distance". As illustrated in FIG. 11, the length of the cable 1054 from the regulating portion 1062 to the part connected to the connector 1055 is longer than the above-described "shortest distance".

That is, the length of the cable 1054 from the regulating portion 1062 to one end side of the cable 1054 (the part where the cable 1054 is connected to the connector 1055) in a state where the cable 1054 is connected to the connector 1055 is a length in which the connector 1055 is located on the front side of the opening 2010 when the optical print head 105 moves to the pull-out position in the state where the cable 1054 is connected to the connector 1055.

With the above-described configuration, the operator can pull the optical print head 105 out to the pull-out position which is the position where at least a part of the connector 1055 is located to be closer to the front side of the apparatus body than the opening 2010 of the front plate 2001. The operator removes the cable 1054 from the connector 1055 located on the front side of the opening 2010 by moving the optical print head 105 to the pull-out position. Thereafter, the operator further pulls out the optical print head 105 toward the front side of the apparatus body, and performs maintenance of the optical print head 105.

Figure 13A:
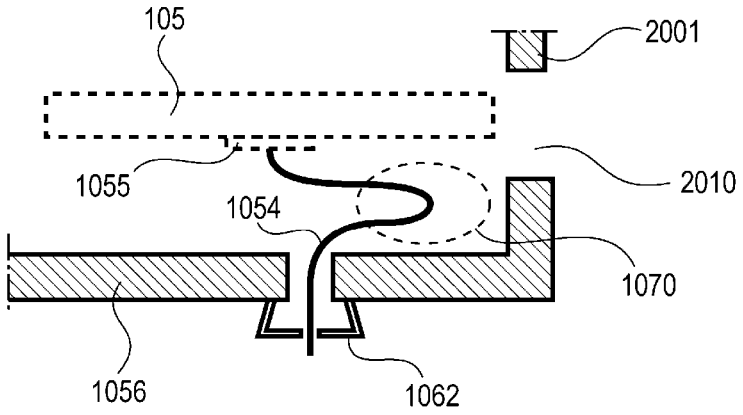
FIGS. 13A to 13C are views for describing a curved area of the cable.
Figure 13B:
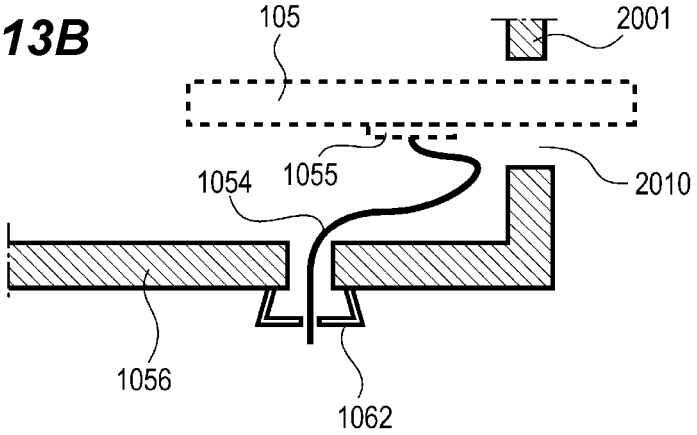
Figure 13C:
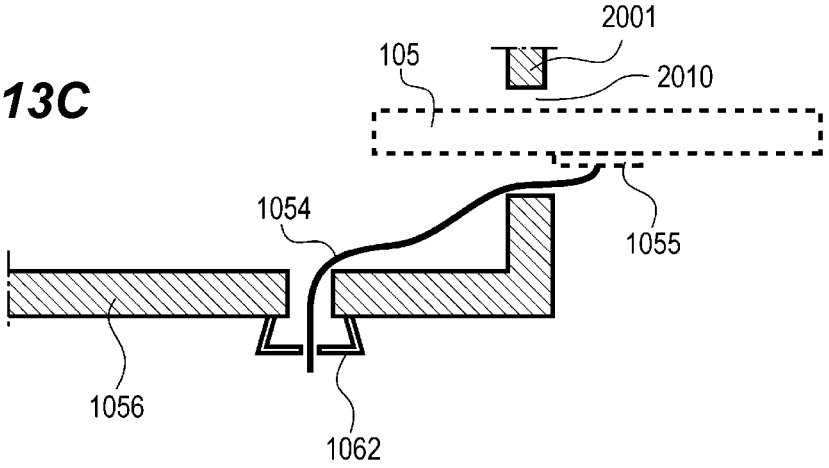

As illustrated in FIGS. 13A to 13C, a configuration in which a part of the cable 1054 is curved may be adopted as long as the optical print head 105 is moved by the operator from the pull-out position to the mounting position. FIG. 13A is a view for describing a state where the optical print head 105 is located at the mounting position, FIG. 13B is a view for describing a state where the optical print head 105 is in the middle of moving from the mounting position toward the pull-out position, and FIG. 13C is a view for describing a state where the optical print head 105 is located at the pull-out position. As illustrated in FIG. 13C, when the optical print head 105 is at the pull-out position, the connector 1055 is located on the front side of the opening 2010. Incidentally, the state where the connector 1055 is located on the front side of the opening 2010 means a state where at least a part of the connector 1055 is located on the front side of the opening 2010. If at least a part of the connector 1055 is located on the front side of the opening 2010, the operator can touch the connector 1055 and the cable 1054 on the front side of the opening 2010 and can detach the cable 1054 from the connector 1055. The length of the cable 1054 from the regulating portion 1062 to the connector 1055 is defined to be a length that enables the connector 1055 to be located on the front side of the opening 2010 when the operator moves the optical print head 105 to the pull-out position.

As illustrated in FIG. 13A, when the operator moves the optical print head 105 to the mounting position, a part of the cable 1054 is curved to form a curved area 1070. It is necessary to sufficiently set the length of the cable 1054 from the regulating portion 1062 to the connector 1055 in order to enable the connector 1055 to be located on the front side of the opening 2010 when the optical print head is located at the pull-out position. Therefore, when the optical print head 105 is at the mounting position, the cable 1054 is accommodated in the inside of the apparatus body in a curved state. In the embodiment, a flexible flat cable is used as an example of the cable 1054. In the flexible flat cable, a plurality of bundles of wires (electric wires) is juxtaposed in parallel at regular intervals and sandwiched between two thin insulating films. Polyethylene terephthalate (PET), which is relatively excellent in mechanical strength, is used for the insulating film in consideration of wear resistance. Thus, the flexible flat cable according to the embodiment has a certain strength, and its shape is stored for a while if being folded. Therefore, even when the optical print head 105 reciprocates between the mounting position and the pull-out position in a state where the cable 1054 is connected to the connector 1055, the cable 1054 is curved only to a shape fixed to a certain extent. In the embodiment, the cable 1054 is curved so as to be bent toward the front side of the apparatus body in the curved area 1070 in the state where the optical print head 105 is moved to the mounting position. In other words, the curved area 1070 of the cable 1054 is curved in a direction from the back side to the front side of the apparatus body. Incidentally, a bending direction of the cable 1054 in the curved area 1070 when the optical print head 105 is located at the mounting position may be a direction from the front side to the back side of the apparatus body. That is, the curved area 1070 of the cable 1054 may be curved in the direction from the front side to the back side of the apparatus body. In this case, the curved area 1070 is located on the back side of the apparatus body of the connector 1055.

Figure 14:
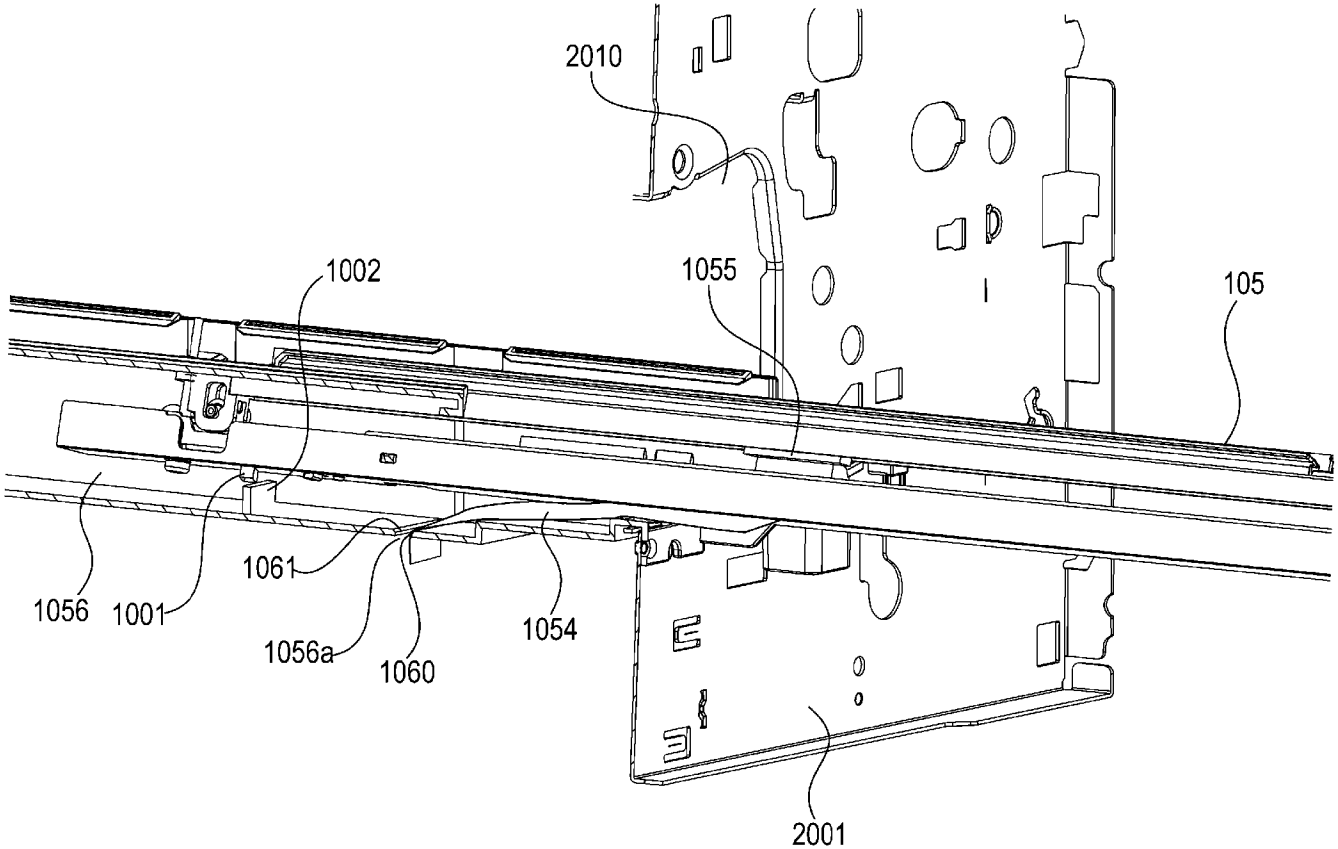
FIG. 14 is a perspective view for describing a stopper of the optical print head.

As illustrated in FIG. 14, a stopper 1001 may be provided on the first support member 1051 of the optical print head 105. The stopper 1001 is a convex portion (projection) that projects from the optical print head 105 toward the second support member (the lower side in the vertical direction) on the surface of the first support member 1051 on the side of the second support member 1056. The stopper 1001 is formed on the first support member 1051 on the back side of the portion where the connector 1055 of the optical print head 105 is arranged. An abutment portion 1002 on which the stopper 1001 abuts in a direction from the back side to the front side of the apparatus body when the optical print head 105 is pulled out by the operator is provided on the front side of the guide portion 1059 of the second support member 1056. In the state where the optical print head 105 is mounted to the apparatus body, a distance from the stopper 1001 to the abutment portion 1002 is shorter than the length of the cable 1054 between the hole 1056*a* and the connector 1055. As a result, when the operator pulls out the optical print head 105 through the opening 2010 of the front plate 2001, it is possible to prevent the cable 1054 from being damaged due to disconnection or the like.

(Work of Detaching Optical Print Head from Image Forming Apparatus)

Next, the work of detaching the optical print head 105 of the embodiment from the image forming apparatus will be described. Table 1 shows a procedure to detach the optical print head 105 of the embodiment from the image forming apparatus. In the embodiment, the detachment can be performed with the following two actions as shown in Table 1.

TABLE 1

| ACTION | STANDING POSITION OF OPERATOR | WORK CONTENT |
|---|---|---|
| 1 | FRONT | OPTICAL PRINT HEAD IS PULLED OUT TO FRONT SIDE OF IMAGE FORMING APPARATUS |
| 2 | FRONT | CABLE IS REMOVED FROM CONNECTOR OF OPTICAL PRINT HEAD |

An operator stands on the front side of the image forming apparatus (on the front plate 2001 side) and opens the cover 558 (see FIGS. 3A to 3D) on the front side of the image forming apparatus 1000 to form a state where the opening to insert the optical print head 105 is visually confirmed. In this state, the operator removes the small screw 2003 from the attachment portion 1053 and pulls out the optical print head 105 to the front side of the image forming apparatus 1000 (Action 1). Next, the cable 1054 is detached from the connector 1055 provided in the optical print head 105 (Action 2).

A configuration in which a cable 1054 is wired on the back side of an image forming apparatus 1000 similarly to the conventional example is illustrated as a comparative example. In this comparative example, the work of detaching an optical print head 105 from the image forming apparatus 1000 will be described. Table 2 shows a procedure to detach the optical print head 105 of the comparative example from the image forming apparatus 1000. In the comparative example, the following three actions are required as shown in Table 2. Here, a case where a standing position of an operator at the time of detaching the cable 1054 from a connector 1055 is set to a side surface side of the image forming apparatus 1000 will be exemplified.

TABLE 2

| ACTION | STANDING POSITION OF OPERATOR | WORK CONTENT |
|---|---|---|
| 1 | FRONT | OPTICAL PRINT HEAD IS PULLED OUT TO FRONT SIDE OF IMAGE FORMING APPARATUS |
| 2 | SIDE SURFACE | CABLE IS REMOVED FROM CONNECTOR OF OPTICAL PRINT HEAD |
| 3 | FRONT | OPTICAL PRINT HEAD IS PULLED OUT TO FRONT SIDE OF IMAGE FORMING APPARATUS |

First, the optical print head 105 is pulled out from the front side of the image forming apparatus 1000 (Action 1). Here, the optical print head 105 is removed from the rear plate 2002, but a part of the optical print head 105 exists inside the image forming apparatus 1000.

Next, the inside of the image forming apparatus 1000 is accessed from the side surface side of the image forming apparatus 1000, and the cable 1054 is detached from the optical print head 105 (Action 2). Although the operator can stand on the front side of the image forming apparatus 1000 and detach the cable 1054 from the optical print head 105, it is necessary for the operator to put his or her arm inside the apparatus body from the opening 2010 of the front plate 2001 to perform the work so that the work becomes troublesome.

Then, the operator again stands on the front side of the image forming apparatus 1000 and pulls out the optical print head 105 from the front side of the image forming apparatus 1000 (Action 3).

As described above, the work requires to move back and forth between the front side and the side surface side of the image forming apparatus 1000 so that the work becomes troublesome in the comparative example. In the embodiment, however, the work of pulling out the optical print head 105 is entirely performed on the front side of the image forming apparatus 1000. In the comparative example, even when the operator tries to stand on the front side of the image forming apparatus 1000 to detach the cable 1054 from the connector 1055 in Action 2, the operator needs to perform the work of detaching the cable 1054 from the connector 1055 inside the apparatus body so that the work becomes troublesome.

Accordingly, when adopting the configuration of the embodiment, the workability is improved as compared with the case of adopting the configuration of the comparative example. That is, according to the embodiment, it is possible to make the attachment and detachment work of the cable 1054 and insertion and removal work of the optical print head 105 performed from the only one direction (the front side of the image forming apparatus) and to facilitate the work of detaching the optical print head from the image forming apparatus.

Since the work is performed from two directions of the front side and the side surface side of the image forming apparatus in the comparative example, the optical print head is pulled out in a state where the cable is attached to the optical print head so that there is a risk that a work mistake such as disconnection of the cable may occur. Thus, it is necessary to additionally provide a unit that prevents the occurrence of the work mistake, and there is a risk of introducing an increase in the number of parts or making the apparatus complicated and large.

In the embodiment, however, the work mistake as in the comparative example hardly occurs since the work is performed from one direction on the front side of the image forming apparatus. Accordingly, it is possible to maintain a small size, which is a feature of the optical print head, without increasing the number of parts and making the apparatus complicated and large.

In the embodiment, the cable 1054 is removed from the connector 1055 of the optical print head 105 in the state illustrated in FIG. 11. At this time, a portion in an area D1 of the cable 1054 of FIG. 4 can be taken in and out from the front plate 2001 together with the optical print head 105, it is possible to take out the connector 1055 to the front side of the front plate 2001 directly in the state where the cable 1054 is connected to the connector 1055, and the work of detaching the connector 1055 becomes easy.

Although the four image forming portions and four optical print heads are used in the above-described embodiment, this number of parts to be used is not limited, and may be appropriately set as necessary.

Although the printer is exemplified as the image forming apparatus in the above-described embodiment, another image forming apparatus such as a copying machine and a facsimile machine, or the other image forming apparatus such as a multi-function printer in which these functions are combined may be used.

Although the configuration in which a second connector to which the other end side of the cable is connected is provided on the front plate which is the part of the housing of the apparatus body is exemplified in the above-described embodiment, the invention is not limited thereto. A point to which the connector is fixed may be appropriately set as necessary as long as the connector is on the front side of the apparatus body to which the optical print head is inserted and removed.

Although the configuration in which the connector is provided on the surface on the back side of the front plate 2001 is exemplified as the configuration in which the second connector to which the other end side of the cable is connected to be detachably attachable is provided on the front plate 2001 in the above-described embodiment, the invention is not limited thereto. The connector may be provided on the surface on the front side of the front plate 2001 (the side opposite to the side where the rear plate 2002 is arranged with respect to the front plate 2001). Although the configuration in which the connectors corresponding to the respective optical print heads are arranged collectively on one side in an alignment direction of the optical print heads is exemplified, the invention is not limited thereto. It may be configured such that each of the connectors is arranged around the opening to insert and remove the corresponding optical print head.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-091893, filed May 11, 2018, which is hereby incorporated by reference herein in its entirety.

What is claimed is:

1. An image forming apparatus comprising:

a photoconductor which is rotatable;

an LED head configured to expose the photoconductor to form an image, the LED head having a connector;

a drawing port through which the LED head is drawn out of the image forming apparatus along a rotational axis direction of the photoconductor, the LED head capable of being drawn out to an outside of the image forming apparatus from a mounted position within the image forming apparatus through the drawing port; and a flexible flat cable configured to transmit a driving signal for driving the LED head to the LED head, one end of the flexible flat cable being connected to the connector, wherein the LED head is movable from the mounted position toward the outside of the image forming apparatus via the drawing port along the rotational axis direction in a state in which the one end of the flexible flat cable is connected to the connector, and wherein the flexible flat cable has sufficient length to allow the LED head to be movable to a position where the connector and the one end of the flexible flat cable are exposed from the drawing port.

2. The image forming apparatus according to claim 1, further comprising:

a front plate which is disposed at a front side of the image forming apparatus and supports a front side of the LED head attached to the image forming apparatus; and a rear plate which is disposed at a back side of the image forming apparatus and supports a back side of the LED head attached to the image forming apparatus, wherein the drawing port is formed in the front plate.

3. The image forming apparatus according to claim 2, further comprising a guide plate which connects the front plate and the rear plate and guides movement of the LED head in the rotational axis direction.

4. The image forming apparatus according to claim 3, further comprising a holding portion configured to hold a part of the flexible flat cable, the holding portion being disposed on the guide plate.

5. The image forming apparatus according to claim 4, wherein a length of a part of the flexible flat cable between a portion held by the holding portion and a portion connected to the connector is longer than a length of a part of the flexible flat cable between the holding portion and the drawing port in a case of connecting the holding portion and the drawing port by the flexible flat cable without loosening the flexible flat cable.

6. The image forming apparatus according to claim 4, wherein the flexible flat cable has a curved area formed as a part of an area of the flexible flat cable from the holding portion to a connecting portion connected to the connector and that is curved in a state in which the LED head is attached to the image forming apparatus.

7. The image forming apparatus according to claim 6, wherein the curved area is curved in either of a direction from the rear side to the front side of the image forming apparatus and a direction from the front side to the rear side of the image forming apparatus.

8. The image forming apparatus according to claim 4, wherein with respect to a direction of withdrawing the LED head from the image forming apparatus, the connector is located on an upstream side of the holding portion in a state in which the LED head is attached to the image forming apparatus.

9. The image forming apparatus according to claim 2, wherein the LED head and the front plate are fastened by a screw and the LED head is fixed to the front plate in a state in which the LED head is attached to the image forming apparatus.

10. The image forming apparatus according to claim 9, wherein the rear plate is formed with a positioning hole to which the rear side of the LED head is fitted, and the rear side of the LED head is positioned with respect to the rear plate to be supported by the rear plate as the rear side of the LED head is fitted to the positioning hole.

11. The image forming apparatus according to claim 2, further comprising an opening and closing cover, the opening and closing cover configured to move to a closing position for closing the drawing port and an opening position for opening the drawing port.

12. The image forming apparatus according to claim 1, wherein the flexible flat cable has sufficient length to allow the LED head to be withdrawn up to a position where the whole connector is exposed from the drawing port.

13. The image forming apparatus according to claim 1, wherein the LED head exposes the photoconductor from below.

14. The image forming apparatus according to claim 1, wherein the image forming apparatus includes a plurality of photoconductors and the plurality of photoconductors are disposed so as to be aligned along a direction perpendicular to the rotational axis direction.

* * * * *